US008973682B2

(12) United States Patent
Gosselin

(10) Patent No.: US 8,973,682 B2
(45) Date of Patent: Mar. 10, 2015

(54) WELLBORE OBSTRUCTION CLEARING TOOL AND METHOD OF USE

(75) Inventor: Randall E. Gosselin, High River (CA)

(73) Assignee: Longhorn Casing Tools Inc.

( * ) Notice: Subject to any disclaimer, the term of this patent is extended or adjusted under 35 U.S.C. 154(b) by 339 days.

(21) Appl. No.: 13/062,129

(22) PCT Filed: Jan. 20, 2011

(86) PCT No.: PCT/CA2011/050032

§ 371 (c)(1), (2), (4) Date: Jul. 30, 2012

(87) PCT Pub. No.: WO2011/088576

PCT Pub. Date: Jul. 28, 2011

(65) Prior Publication Data

US 2012/0285743 A1 Nov. 15, 2012

Related U.S. Application Data

(60) Provisional application No. 61/297,365, filed on Jan. 22, 2010, provisional application No. 61/386,291, filed on Sep. 24, 2010.

(51) Int. Cl.

| | |
|---|---|
| ***E21B 21/00*** | (2006.01) |
| ***E21B 37/00*** | (2006.01) |
| ***E21B 17/07*** | (2006.01) |

(52) U.S. Cl.

CPC ..... *E21B 37/00* (2013.01); *E21B 17/073* (2013.01)

USPC ..... 175/322; 175/323; 166/311

(58) Field of Classification Search

USPC ..... 175/322, 320, 106, 305, 214, 323; 166/311, 175

See application file for complete search history.

(56) References Cited

U.S. PATENT DOCUMENTS

| | | | | | |
|---|---|---|---|---|---|
| 1,388,496 | A | * | 8/1921 | Wadsworth | 175/318 |
| 1,612,889 | A | * | 1/1927 | Smith | 175/57 |
| 1,641,206 | A | * | 9/1927 | Smith | 175/322 |
| 1,688,994 | A | * | 10/1928 | Smith | 175/321 |
| 1,785,086 | A | * | 12/1930 | Hauk | 175/317 |
| 3,405,771 | A | * | 10/1968 | Carr et al. | 175/73 |
| 4,270,620 | A | * | 6/1981 | Lawrence | 175/322 |

(Continued)

FOREIGN PATENT DOCUMENTS

| | | |
|---|---|---|
| WO | PCT/CA99/00636 | 8/2000 |
| WO | PCT/US2004/003164 | 8/2004 |

OTHER PUBLICATIONS

PCT Search Report for PCT/CA2011/050032, dated May 2, 2011.

(Continued)

*Primary Examiner* — Kenneth L Thompson

(74) *Attorney, Agent, or Firm* — Sean W Goodwin

(57) ABSTRACT

A wellbore obstruction-clearing tool connected to the bottom of a tubing string, such as casing, utilizes a sleeve which is axially and rotationally moveable in response to axial reciprocation of a tubing string to engage and clear obstructions in the wellbore. Fluid is discharged through the casing and the tool to engage the obstructions and to convey debris through the annulus to surface. Thus, the obstructions are cleared from the wellbore, permitting the casing to be advanced, without the need to rotate the casing.

21 Claims, 22 Drawing Sheets

(56) References Cited

U.S. PATENT DOCUMENTS

| | | | | |
|---|---|---|---|---|
| 4,443,206 | A * | 4/1984 | Teng | 464/20 |
| 5,669,458 | A * | 9/1997 | Anders | 175/299 |
| 6,062,326 | A | 5/2000 | Strong et al. | |
| 7,410,013 | B2 | 8/2008 | Fisher | |
| 7,849,927 | B2 | 12/2010 | Herrera | |
| 8,191,655 | B2 * | 6/2012 | Declute-Melancon | 175/322 |
| 2002/0079103 | A1 | 6/2002 | Knowles | |
| 2008/0149393 | A1 | 6/2008 | McClain et al. | |
| 2008/0236813 | A1 | 10/2008 | Bain | |
| 2010/0032170 | A1 | 2/2010 | Howett et al. | |
| 2011/0012455 | A1 | 1/2011 | Scott | |

OTHER PUBLICATIONS

Antony Fisher et al., Extending the Boundries of Casing Drilling, IADC/SPE 87998 Article, 2004.

A.K. Gupta, Drilling with Casing: Prospects and Limitations, SPE 99536 Article, 2006.

Michael Moffitt and Erik Eriksen, Liner Drilling with a Multiset Hanger and Retrievable BHA, SPE 137088 Article, 2010.

Greg Galloway, Rotary Drilling with Casing—A Field Proven Method of Reducing Wellbore Construction Cost, WOCD-0306-02 Article, 2003.

* cited by examiner

WELLBORE OBSTRUCTION CLEARING TOOL AND METHOD OF USE

FIELD OF THE INVENTION

Embodiments herein related to apparatus and methods for clearing obstructions in wellbores during casing of the wellbores and more particularly to apparatus connected at a bottom of a typically non-rotating tubular string for clearing obstructions encountered in the wellbore as the tubular string is run into an open hole, such as prior to cementing.

BACKGROUND OF THE INVENTION

In the oil and gas industry, following drilling of a vertical or horizontal wellbore into a formation for the production of oil or gas therefrom, the wellbore is typically cased and cemented to line the length of the wellbore to ensure safe control of production of fluids therefrom, to prevent water from entering the wellbore and to keep the formation from "sloughing" or "bridging" into the wellbore.

It is well known that during the running in of a tubing string, such as casing and particularly the production casing, the casing may encounter tight spots and obstructions in the open wellbore, such as that created by sloughing of the wellbore wall into the open hole or as a result of the casing pushing debris ahead of the bottom end of the casing along the open hole until it forms a bridge. Such obstructions prevent the advance of the casing and require the open hole to be cleared in order to advance the casing to the bottom of the hole. This is particularly problematic in horizontal wellbores.

Should the casing string become sufficiently engaged in a mud pack formed at the obstruction, differential sticking may also occur, making advancing or removal of the casing from the wellbore extremely difficult.

While casing strings have been rotated to assist with moving past or through an obstruction, high torque created by trying to rotate a long string of casing may result in significant damage to the threads between casing joints and may cause centralizers and the like to drag and ream into the wellbore. While rotation of casing may be a viable option in a vertical wellbore, albeit fraught with problems, it is extremely difficult, if not impossible in a horizontal wellbore.

One option is to employ a washing technique, pumping fluids through the casing while the casing is axially reciprocated uphole and downhole. The fluids exiting the downhole end of the casing bore act on the obstruction in the wellbore to wash out or erode the wellbore obstruction creating debris which is lifted or conveyed through the annulus to surface by fluid circulation therein. Should the washing technique be unsuccessful, it is known to trip out the casing and run in a mud motor on a drill string to drill out or ream the obstruction from the wellbore. Such repeated running in and tripping out of tubulars is time consuming, labor intensive and, as a result, very expensive. Alternatively, others have contemplated providing teeth on the bottom of the casing string or on a shoe at the bottom of the casing string to assist with cutting away the obstruction as the casing is advanced during running in. Typically, the casing is also reciprocated or stroked during the clearing operation, or, in some cases, at the same time as the casing is rotated.

Further, it has been contemplated to attach costly apparatus, such as mud motors, jetting or reaming tools, to the bottom of the casing string, however the apparatus is not retrievable thereafter from the wellbore and adds significantly to the cost of the casing operation.

Ideally, what is required is a relatively simple and inexpensive apparatus that can be incorporated into the casing string for clearing wellbore obstructions without the need for rotating the casing string. Ideally, the apparatus could be left downhole, after the casing and cementing operations are complete, without a significant increase in operational costs.

SUMMARY OF THE INVENTION

A wellbore obstruction-clearing tool is fit to a downhole end of a string of tubulars, such as a casing string or a string of coiled tubing (CT). The tool comprises a tubular mandrel having a rotatable tubular sleeve concentrically fit thereabouts. A helical drive is positioned between the mandrel and the sleeve, permitting the sleeve to reciprocate axially along the mandrel and to rotate relative thereto. The sleeve is driven to extend or retract axially and to rotate relative to the mandrel through axial reciprocation of the tubulars and the mandrel in the wellbore, commonly referred to as stroking of the tubulars within the wellbore. At least the rotation of the sleeve engaging the wellbore obstructions causes the obstructions to break up or erode, forming debris therefrom which is conveyed to surface by fluids circulated downhole through the string and uphole to surface in an annulus between the tubulars and the wellbore. The fluids can also aid in hydraulically extending the sleeve during the upstroke and fluidly eroding wellbore obstructions.

In a broad aspect, a wellbore obstruction-clearing tool is fit to a downhole end of a tubing string for advancing the tubing string through obstructions in a wellbore. The tubing string has an axial bore therethrough for communicating fluids to an annulus between the tubing string and the wellbore for circulation to surface. The obstruction-clearing tool comprises ad tubular mandrel a tubular sleeve and a helical drive therebetween. The tubular mandrel connects to the downhole end of the tubing string, the mandrel having a mandrel bore extending axially therethrough, and the mandrel bore being fluidly connected to the axial bore. The tubular sleeve has a sleeve bore extending axially therethrough and fit concentrically fit about the mandrel, the sleeve bore being fluidly connected with the mandrel bore, and a downhole end for engaging the wellbore obstructions. The helical drive arrangement acts between the mandrel and the sleeve for driving the sleeve axially and rotationally along the mandrel between a retracted position and an extended position in response to reciprocating axial movement of the tubing string and mandrel. The engagement of the downhole end of the sleeve creates debris from the wellbore obstructions, and wherein the fluids from the sleeve bore convey debris along the annulus to surface.

The obstruction-clearing tool enables methods for clearing obstructions in a wellbore and advancing a tubing string therein without rotation of the tubing string. Such method comprises running a wellbore obstruction-clearing tool on a downhole end of the tubing string, such as casing or CT, the wellbore obstruction-clearing tool having a tubular mandrel for connection to the tubing string and tubular sleeve which is axially and rotationally moveable therealong between a retracted position and an extended position; and when the wellbore obstruction-clearing tool encounters a wellbore obstruction. In operation, the method comprises stroking the tubing string uphole and downhole so as to drive the tubular sleeve to rotate and reciprocate axially between the retracted position and the extended position for engaging the wellbore obstruction and creating debris therefrom; and discharging fluid through contiguous bores in the tubing string, the mandrel and the sleeve for conveying debris to surface.

BRIEF DESCRIPTION OF THE DRAWINGS

FIG. 9A is a longitudinal side view of the tool in the extended position;

FIG. 9B is a partial sectional view of FIG. 9A with the mandrel is side view and the sleeve in cross-sectional view;

FIG. 9C is a partial sectional view of FIG. 9B with the sleeve retracted over the mandrel;

DETAILED DESCRIPTION OF THE INVENTION

Embodiments of a wellbore obstruction-clearing tool are connected to a downhole end of a string of tubulars, such as casing or coiled tubing (CT), to aid in advancing or removing the tubulars within a wellbore. Thus, the obstruction-clearing tool obviates the need to rotate the casing thereby, substantially avoiding problems associated therewith, such as torque build up along the casing. For the purposes of the description which follows, Applicant has described the tool in the context of use with casing. Those of skill in the art will appreciate however, that embodiments disclosed herein are not limited for use with casing and are suitable for use with other tubulars having a bore formed therethrough and for which rotation is to be avoided.

In embodiments, a tubular sleeve is caused to rotate while extending and retracting along a mandrel connected to the downhole end of the casing. Axial reciprocation and rotation of the sleeve along the mandrel is initiated by axial reciprocation of the casing in the wellbore, commonly referred to as stroking of the casing. At least the rotation of the sleeve within the wellbore clears any obstruction, creating debris, the debris being conveyed to surface by circulation of fluids downhole through the casing and uphole to surface through an annulus between the casing and the wellbore. When the obstructions are removed from the wellbore, the casing can be lowered to a target depth such as prior to cementing the casing into place in the wellbore.

In embodiments, fluid, such as a drilling fluid, is injected or pumped downhole through the casing. The mud is circulated up the annulus for conveying the debris to surface. Further, extending or resetting of the tubular sleeve can be through hydraulic impetus from the drilling fluid and gravity depending on the wellbore orientation. The fluids discharging from the casing can also aid in clearing obstructions by fluidly engaging the wellbore obstructions, such as in a jetting action, fluidly eroding the wellbore obstructions for creating debris therefrom. A velocity of the fluids discharged can be increased for enhancing the fluid erosion. The downhole end of the sleeve can also physically disrupt the obstructions for creating debris therefrom.

Figure 1:
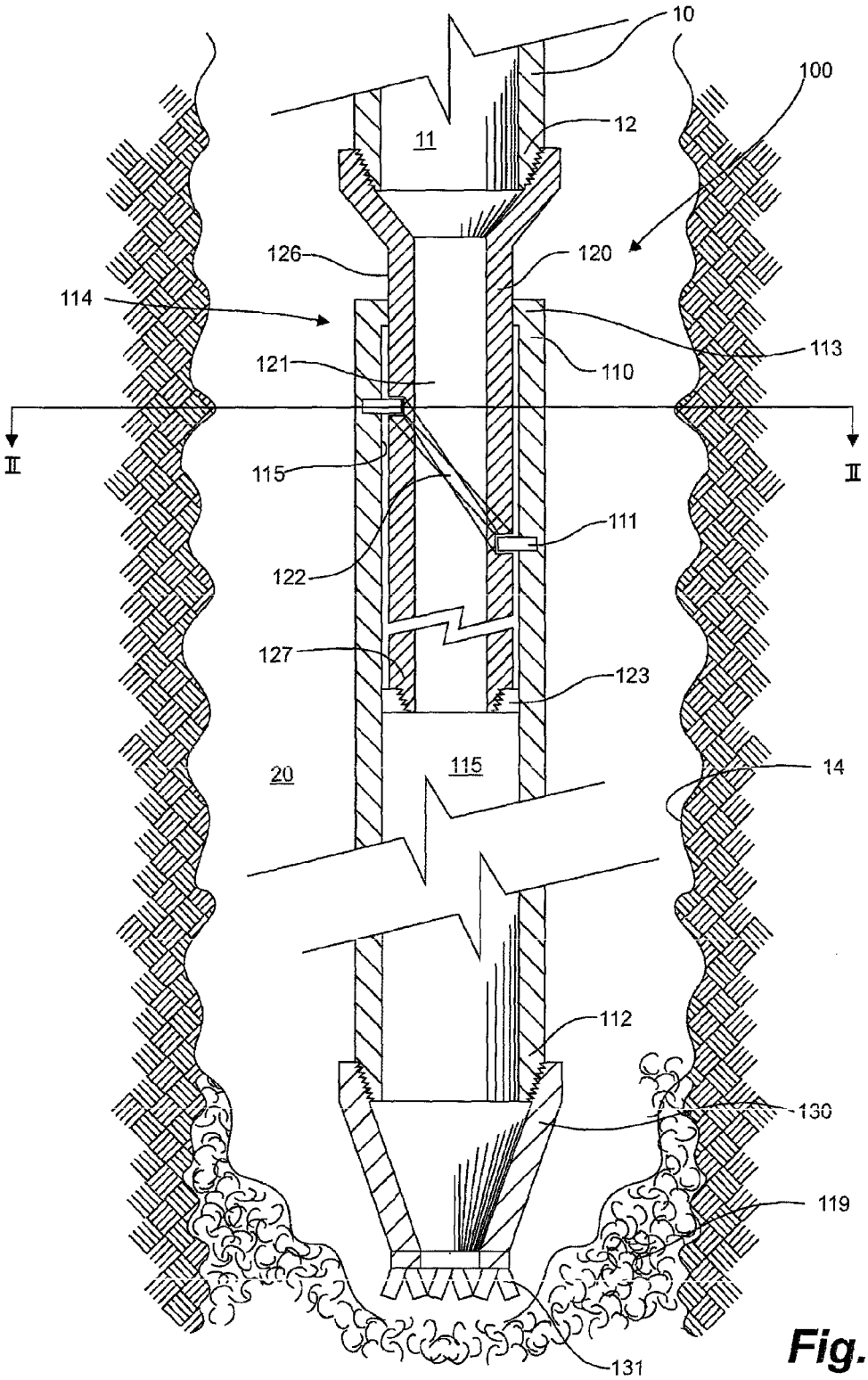
FIG. 1 is a fanciful schematic sectional view of an embodiment of obstruction-clearing tool connected to a downhole end of a casing string.
Figure 2:
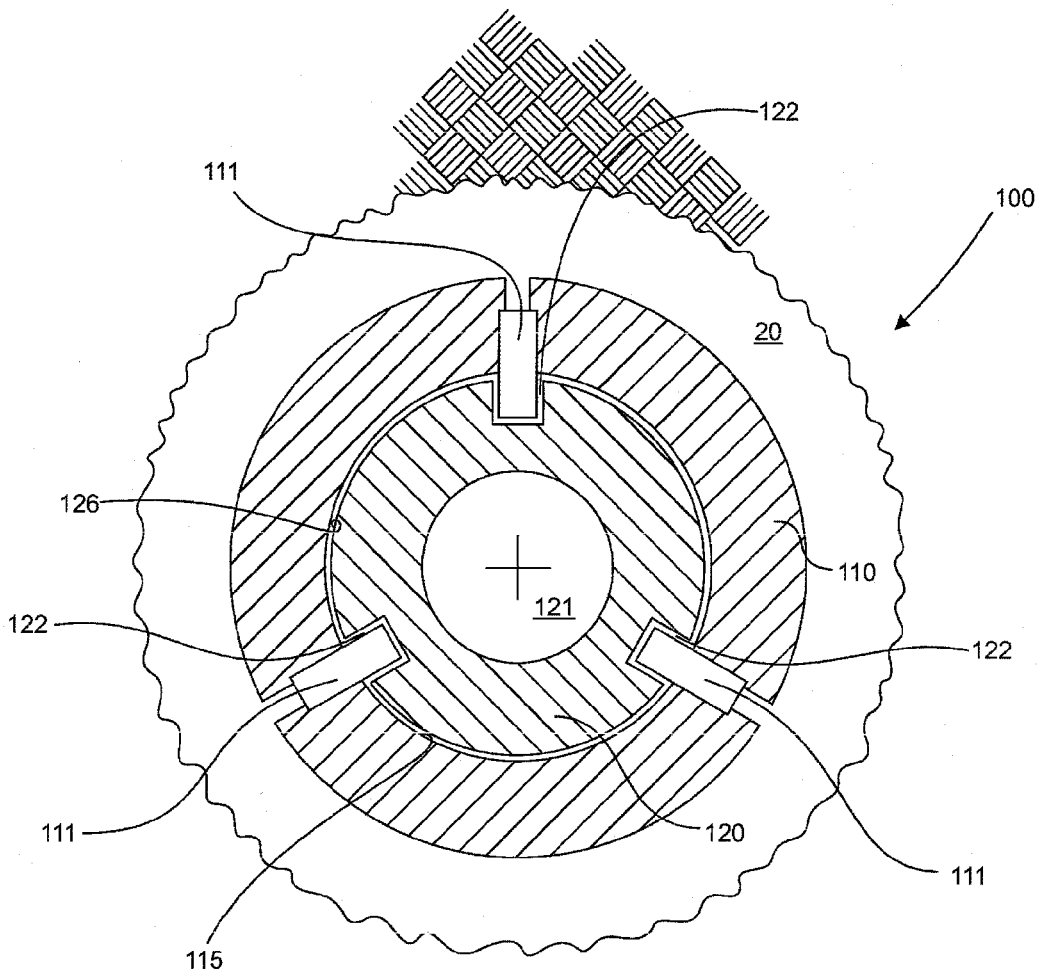
FIG. 2 is a cross-sectional view of the tool of FIG. 1, taken along section lines II-II, and illustrating guide pins on an inner surface of a sleeve engaging helical grooves on an outer surface of a mandrel.

In more detail, and having reference to FIGS. 1 and 2 of one embodiment, an obstruction-clearing tool 100 is connected at a downhole end 12 of a tubing string, such as casing 10 or coiled tubing (CT) for clearing obstructions 119 from a wellbore 14.

The obstruction-clearing tool 100 comprises a tubular mandrel 120, connected, such as by threading, to the downhole end 12 of the casing 10 and having a mandrel bore 121 which is fluidly connected to an axial bore 11 of the casing 10.

A tubular sleeve 110 having a sleeve bore 115 is fit concentrically about the tubular mandrel 120 and is axially displaceable therealong between a fully retracted position, wherein a downhole end 112 of the sleeve 110 is adjacent a downhole end 127 of the mandrel 120, and a fully extended position, wherein the downhole end 112 of the sleeve 110 is displaced axially away from the downhole end 127 of the mandrel 120.

In embodiments, fluid F is pumped through the contiguous bores of the casing's axial bore 11, the mandrel bore 121 and the sleeve bore 115. The fluid F discharges from the sleeve bore 115 and into the wellbore 14. The fluid F is circulated along an annulus 20, between the casing 10 and the wellbore 14, to surface through the annulus 20.

A drive arrangement 118, co-operates between the mandrel 120 and the sleeve 110, and permits the sleeve 110 to be rotated as the sleeve 110 is axially displaced along the mandrel 120. Thus, the sleeve 110 is axially and rotationally displaceable between the extended and retracted positions.

The tubular sleeve 110 engages obstructions 119 in the wellbore 14. Applicant believes that at least the engagement of the sleeve 110, and rotational movement thereof, aids in agitating or disrupting the obstructions 119. The fluids F discharged through the sleeve bore 115 convey the debris from the wellbore 14 as the fluid F is circulated to surface through the annulus 20. Fluid F, where discharged so as to contact the obstruction 119, further acts to fluidly erode the obstructions 119, enhancing the production of debris therefrom.

In greater detail, as shown in FIGS. 1, 2, 4A and 4B, the drive arrangement 118 is a helical drive arrangement formed between the mandrel 120 and the sleeve 110. One or more helical slots or grooves 122 cooperate with one or more protrusions 111, such as buttons, pins or the like, for guiding the sleeve 110 rotationally and axially relative to the mandrel 120. In an embodiment, the one or more helical grooves 122 are formed on either of an inner surface 115 of the sleeve 110 or on an external surface 126 of the mandrel 120. The one or more protrusions or guide pins 111 extend radially from the other of the outer surface of the mandrel 120 or the inner surface of the sleeve 110.

Referring again to FIGS. 1 to 3, in an embodiment, the helical drive arrangement 118 comprises three helical grooves 122, 122, 122, equally spaced apart in the external surface 126 of the mandrel 120, and three corresponding guide pins 111, 111, 111 spaced equally apart and extending radially inwardly from an inner surface 115 of the sleeve 110. Each pin 111 engages a corresponding helical groove 122. Use of the three helical grooves 122, 122, 122 and corresponding guide pins 111, 111, 111 acts to centralize the mandrel 120 within the sleeve 110. As the sleeve 110 is extended or retracted along the mandrel 120, the sleeve 110 rotates as the pin 111 follows the path of the helical groove 122. The three pins 111, 111, 111 are positioned adjacent the uphole end 114 of the sleeve 110 to permit full axial extension of the sleeve 110 along the mandrel 120. The tolerance between the sleeve 110 and the mandrel 120 is sufficiently tight such that the each guide pin 111 remains in the corresponding helical groove 122, when the tool 100 is assembled. The direction of the helical grooves 122, 122, 122 ensures that rotational loading on the mandrel 120 is compatible with conventional threaded connection of the mandrel 120 to the casing 10 to avoid separation of the obstruction-clearing tool 100 from the casing 10 during use.

Figure 4A:
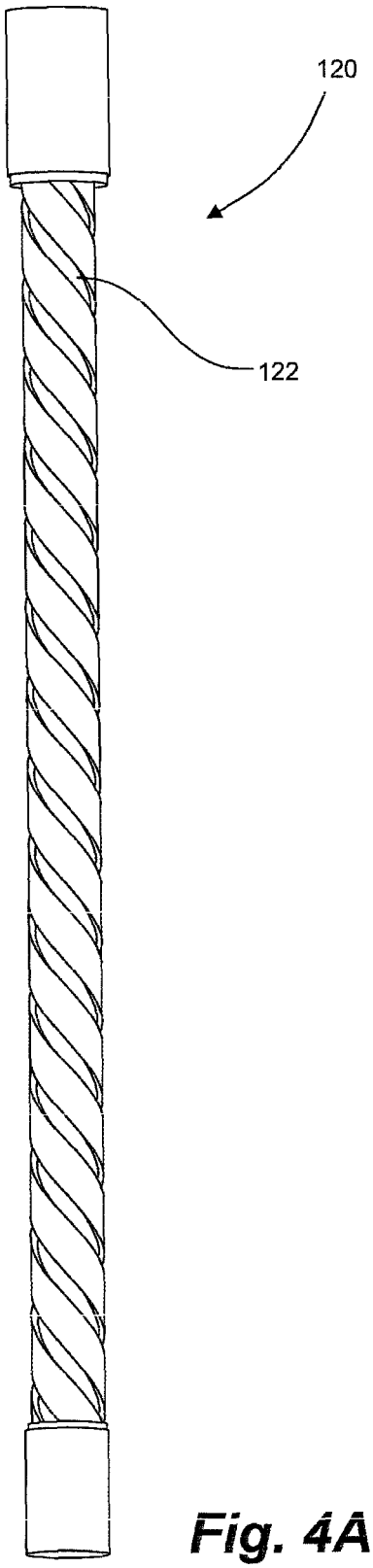
FIG. 4A is a longitudinal side view of a mandrel having helical grooves with a uniform pitch of about 45 degrees.
Figure 4B:
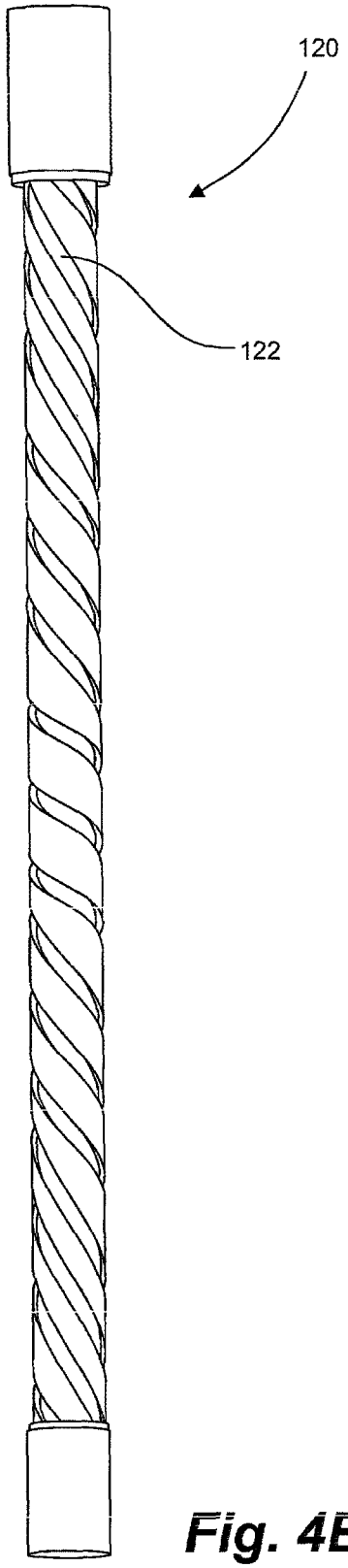
FIG. 4B is a longitudinal side view of a mandrel having helical grooves having a pitch that varies from 60 degrees to 45 degrees, from 45 degrees to 30 degrees, from 30 degrees to 45 degrees, and from 45 degrees to 60 degrees.
Figure 5:
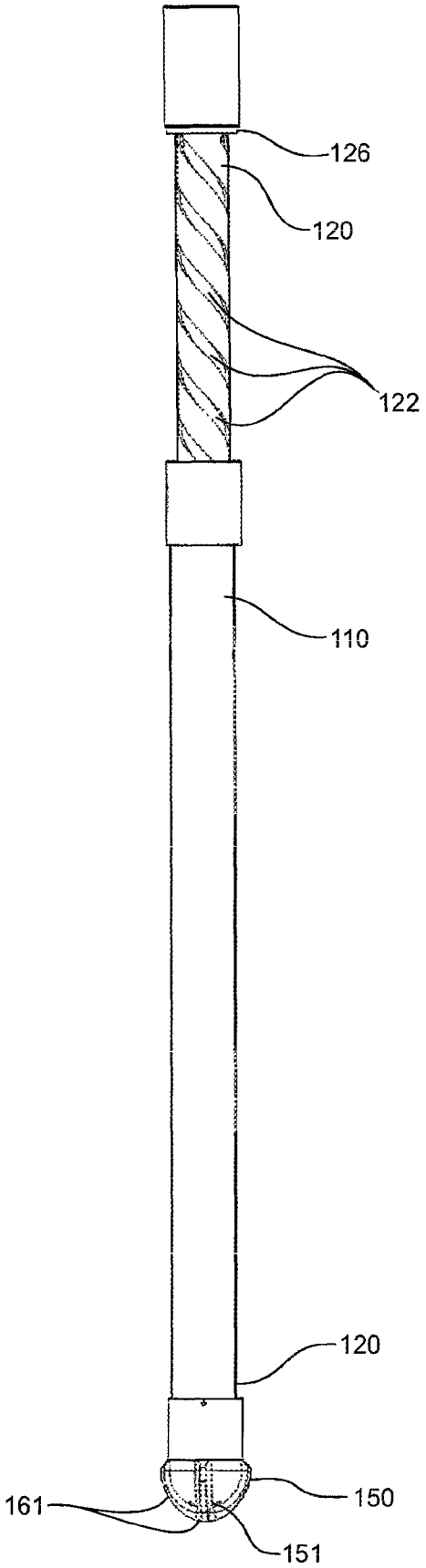
FIG. 5 is a longitudinal perspective view of an embodiment of the obstruction-clearing tool a PDC equipped bit at a downhole end of the sleeve.

With reference to FIGS. 4A and 4B, a pitch of each helical groove 122 may be uniform along the path of the helical grooves 122, being substantially a length of the mandrel 120 (FIG. 4A) or may vary (FIG. 4B) to change the speed of rotation and the corresponding effort to initiate rotation of the sleeve 110 as the sleeve 110 moves axially along the length of the mandrel 120.

In an embodiment as shown in FIG. 4B, the pitch of the helical grooves 122 is about 60 degrees, measured from a transverse plane, at a location adjacent the uphole end 128 of the mandrel 120, which decreases to about 45 degrees, then to about 30 degrees and thereafter increases again from 30 degrees, to about 45 degrees and then to about 60 degrees at the downhole end 127 of the mandrel 120. Thus, the sleeve 110, as it extends or retracts axially along the length of the mandrel 120, begins to easily and slowly rotate at either the uphole or downhole end 128, 127 of the mandrel 120. As the sleeve 110 moves axially along the mandrel 120, the rotational speed increases as the sleeve 110 passes through the about 45 degree section and then the about 30 degree section. Thereafter, as the sleeve 110 continues to move axially and enters the subsequent about 45 degree section, rotation of the sleeve 110 begins to slow and as the sleeve 110 enters the about 60 degree section, the sleeve 110 has slowed once again to the easy, slow rotation.

Axial movement of the mandrel 120, fixed to the casing 10, causes the sleeve 110 to reciprocate along the mandrel 120. A downhole stroke of the casing 10 causes the sleeve 110 to rotate in one direction and an uphole stroke of the casing causes the sleeve 110 to rotate in the opposite direction. The downhole stroke causes the sleeve 110 to retract along the mandrel 120 and the uphole stroke permits the sleeve 110 to extend along the mandrel 120. The impetus to retract the sleeve 110 relative to the mandrel 120 is by resistance encountered at the sleeve, such as by the obstruction 119, or a tight wellbore 14. The impetus to extend the sleeve 110 relative to the mandrel 120 is by hydraulic force created by the fluid F on the downhole end of the sleeve and gravity depending on the orientation of the wellbore, being most effective in vertical wellbores.

In one method of manufacture the sleeve 110 is slipped over the mandrel 120 and the pins 111 are installed through the sleeve 110 to engage the helical grooves 122. The pins 111 are retained therein, such as by deformation of the installation hole, or use of a cap screw or welding.

In an embodiment of the invention, the mandrel 120 is threadably connected to a last joint of casing 10. The uphole end 128 of the mandrel 120 has a box end which is threaded to a conventional pin end at the downhole end 12 of the casing 10. A thickness of the tubular mandrel 120 is generally greater than a thickness of the casing 10 to permit machining of the helical grooves 122 therein.

As shown in FIG. 1 and in greater detail in FIGS. 6B, 6C, 10B and 10C, at least one stop is formed between the sleeve 110 and the mandrel 120 to limit the axial movement of the sleeve 110 along the mandrel 120 and to retain the sleeve 110 thereon.

Figures 6A, 6B, 6C:
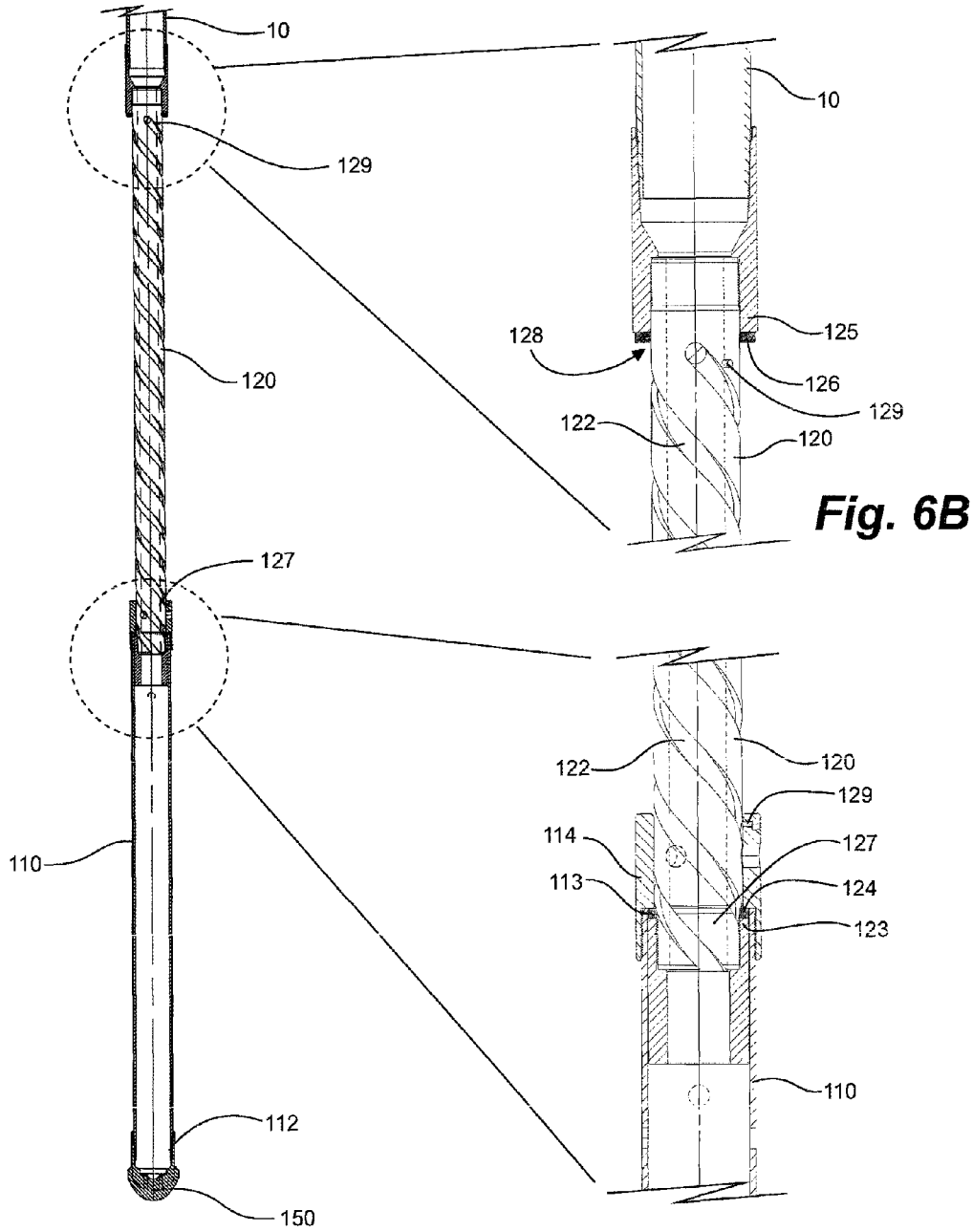
FIG. 6A is a longitudinal partial sectional view of the embodiment of FIG. 5, illustrating the mandrel in side view and the sleeve in cross-sectional view and in an extended position.
FIGS. 6B and 6C are detailed partial sectional views of the mandrel's uphole end and downhole end respectively, according to FIG. 6A.
Figures 10A, 10B, 10C:
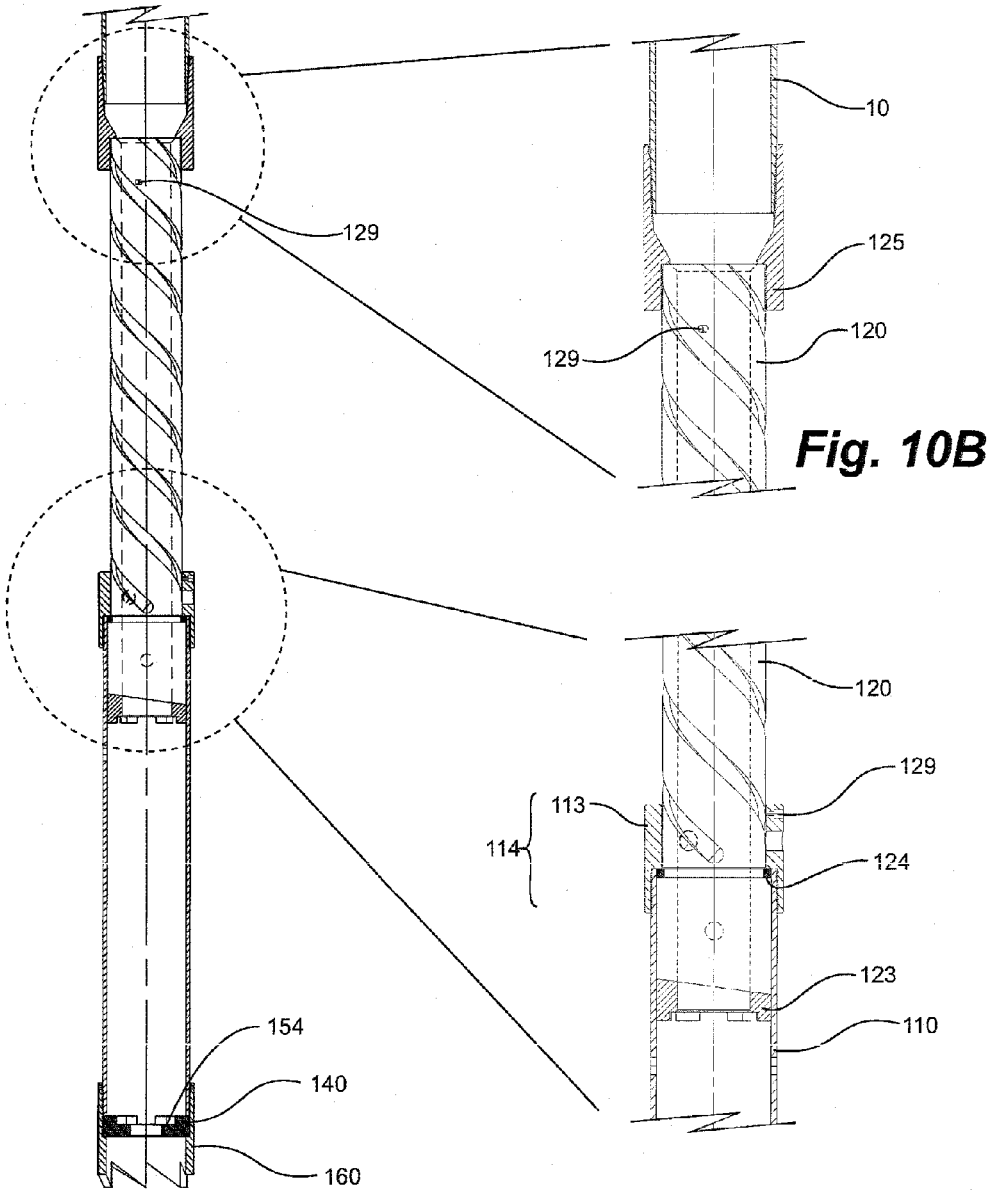
FIG. 10A is a longitudinal partial sectional view of the embodiment of FIG. 9A, illustrating the mandrel in side view and the sleeve in cross-sectional view and in an extended position.
FIGS. 10B and 10C are detailed partial sectional views of the mandrel's uphole end and downhole end respectively, according to FIG. 10A.
Figure 11:
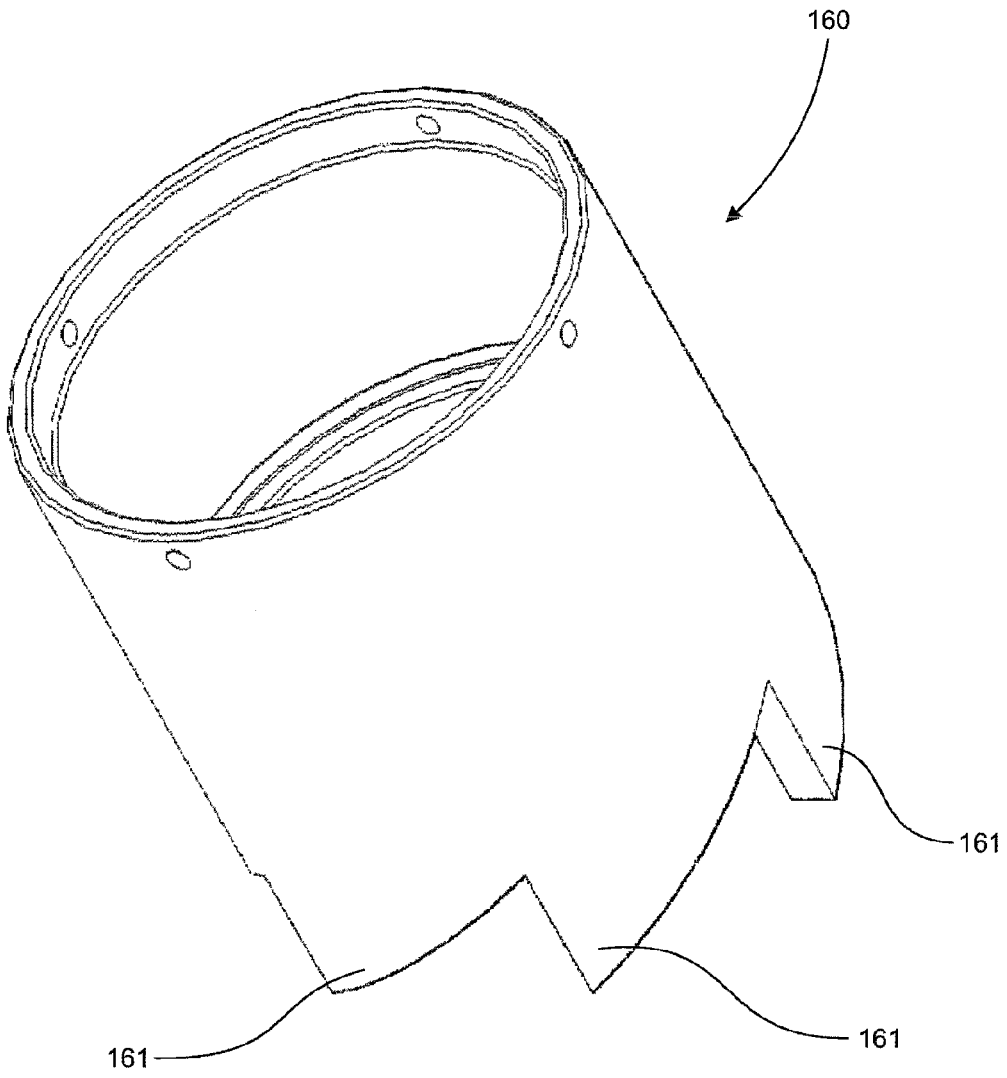
FIG. 11 is a perspective view illustrating the tubular bit of FIG. 10A.

As shown in FIGS. 6C and 10C, an uphole stop 113 is formed at the uphole end 114 of the sleeve 110. A downhole stop 123 is formed between the downhole end 127 of the mandrel 120 and the uphole end 114 of the tubular sleeve 110 for retaining the sleeve 110 on the mandrel 120 when in the fully extended position. Similarly, as shown in FIGS. 6B and 10B, an uphole stop 125 is formed between an uphole end 128 of the mandrel 120 and the sleeve's uphole stop 113 for retaining the sleeve 110 on the mandrel 120 when in the fully retracted position.

Annular seals are positioned to fluidly seal between the sleeve 110 and the mandrel 120. A downhole annular seal 124 is positioned such that the downhole seal 124 becomes sandwiched axially between the mandrel's downhole stop 123 and the sleeve's uphole stop member 113 when the sleeve 110 is in the fully extended position. An annular seal 126 is positioned such that it becomes sandwiched axially between the uphole stop 125 and the sleeve's uphole stop member 113 when the sleeve 110 is in the fully retracted position.

In an embodiment, a shipping or shear pin 129 is employed to maintain the sleeve 110 in the axially retracted position during shipping. Depending on operator technique, the shear pins can also maintain the sleeve 110 in the axially retracted position running-in of the casing 10 and the tool 100. The shear pin 129 extends radially inwardly from the stop member 113 on the uphole end 114 of the sleeve 110 to engage the uphole end 128 of the mandrel 120. When removed after shipping, or if retained, when sheared in the wellbore, the sleeve 110 is freed to reciprocate as described herein in response to the axial reciprocation of the casing 10 and mandrel 120.

Figure 3:
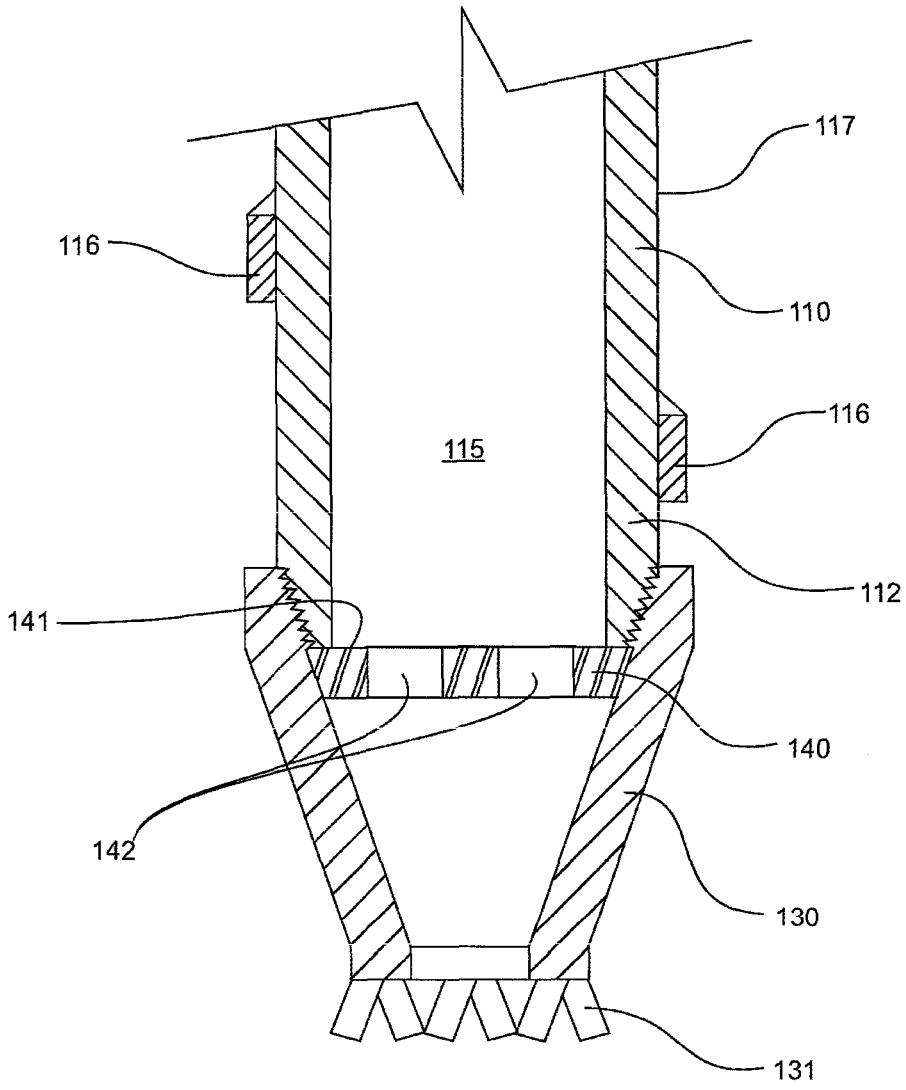
FIG. 3 is a longitudinal sectional view of a tapered discharge of a tool of FIG. 1, the tool having centralizing ribs formed on a sleeve and having a flow restrictor.

As shown in FIGS. 1 and 3, the downhole end 112 of the sleeve 110 may be tapered, such as to a truncated cone shape, so as to narrow the cross-section area of the sleeve bore 115 to increase the velocity of fluids F exiting therefrom. The increase in velocity acts to increase the degree of agitation caused by the fluids F exiting therefrom. Alternatively, the sleeve bore 115 can be configure to affect the fluid F issuing therefrom for forming an extending force and for jetting fluids therefrom.

Having reference again to FIG. 3, in an embodiment, the downhole end 112 of the sleeve bore 115 is fit with a flow restrictor 140. The flow restrictor 140 reduces the diameter of the sleeve bore 115 or forms one or more openings 142 of smaller diameter therein for increasing the extending force acting on the sleeve and for increasing velocity of the fluid F discharged therethrough. The higher velocity causes the discharged fluid F to increase the degree of agitation caused by the fluids F exiting therefrom and to engage the obstructions 119 with greater force to further aid in erosion of the obstructions 119.

In vertical wellbores, stroking the casing 10 uphole permits gravity to act on the sleeve 110 for causing axial extension of the sleeve 110 along the mandrel 120. In the case of horizontal wellbores, there is little to no gravitational impetus to cause axial extension of the sleeve 110. In this case, the flow restrictor 140 further acts to create an uphole face or shoulder 141 upon which the fluid F pumped through the sleeve bore acts, creating a backpressure and an extending force or impetus for hydraulic extension of the sleeve 110.

Optionally, as shown in FIG. 3, ribs 116 may be formed on an outer surface 117 of the sleeve 110 to act as centralizers for avoiding contact between the sleeve 100 and the wellbore 14, preventing reaming of the wellbore 14. In an embodiment, the ribs 116 are helical and are formed on the outer surface 117 of the sleeve 110 to minimize reaming should the ribs 16 come into contact with the wellbore 14. Further, helical ribs 116 provide a passage for fluids circulated in the annulus 20 to surface and therefore do not block the annulus 20 to the passage of fluids therethrough, permitting fluid F and debris to be directed up the annulus 20 to surface.

Further, in the case of horizontal wellbores, the centralizing ribs 116 may engage and drag in the wellbore 14 during uphole stroking of the casing 10, assisting with axial extension of the sleeve 110 relative to the mandrel 120.

In an embodiment, as shown in FIG. 3, the downhole end 112 of the sleeve 110, further comprises a plurality of protrusions 131 (FIG. 3), such as teeth, extending outwardly therefrom. The plurality of protrusions 131 act to either physically engage the obstruction for disrupting the obstruction and forming debris therefrom or to agitate fluid about the obstructions for fluidly eroding the obstruction or a combination thereof. The plurality of protrusions 131 are made from tungsten carbide or are coated with tungsten carbide to increase the strength and to enhance the cutting ability of the plurality of protrusions 131. The plurality of protrusions 131 are formed on the downhole end 112 of the sleeve 110, are welded to the downhole end 112 of the sleeve 110 or are replaceably threaded to the downhole end 112 of the sleeve 110, such as on a threaded shoe 130, as shown in FIG. 1.

Figure 7:
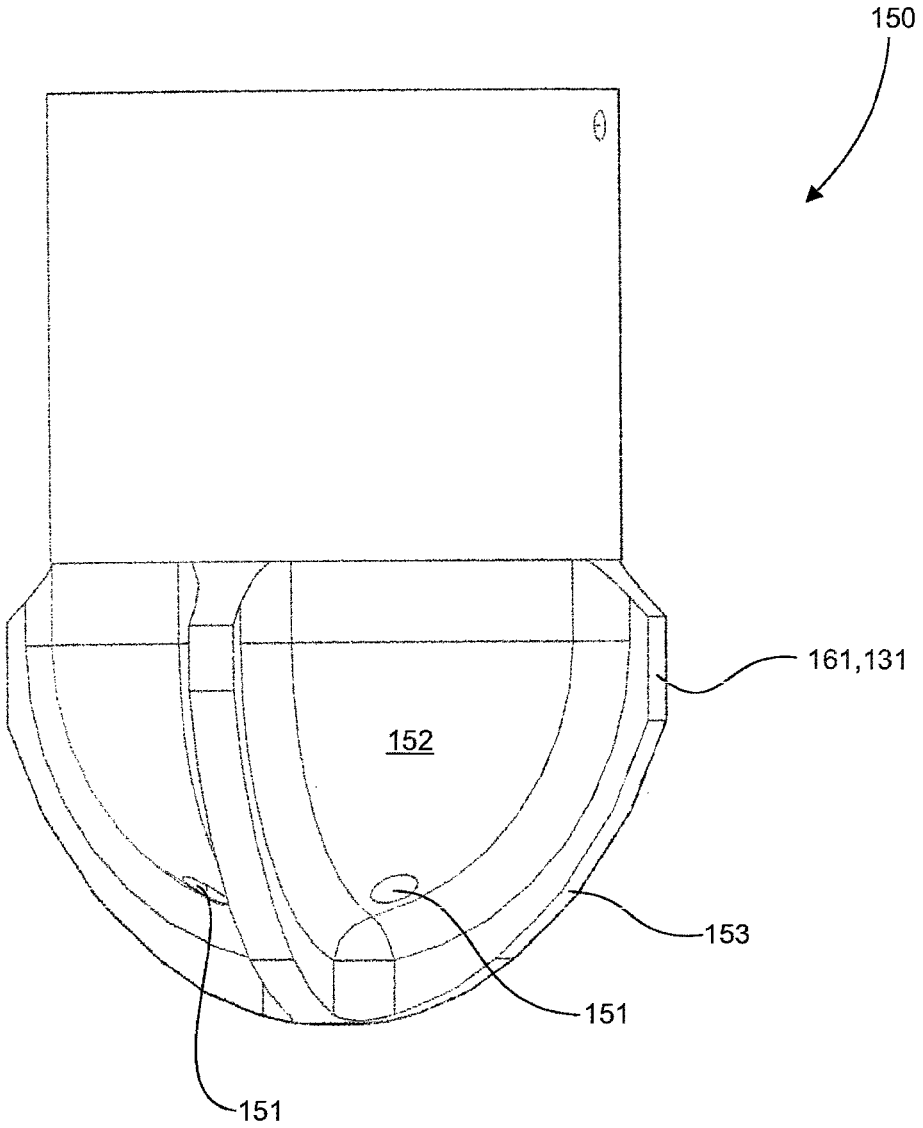
FIG. 7 is a perspective view of a PDC equipped bit embodiment according to FIG. 5, the bit having a plurality of openings for the passage of fluids therethrough.
Figure 12:
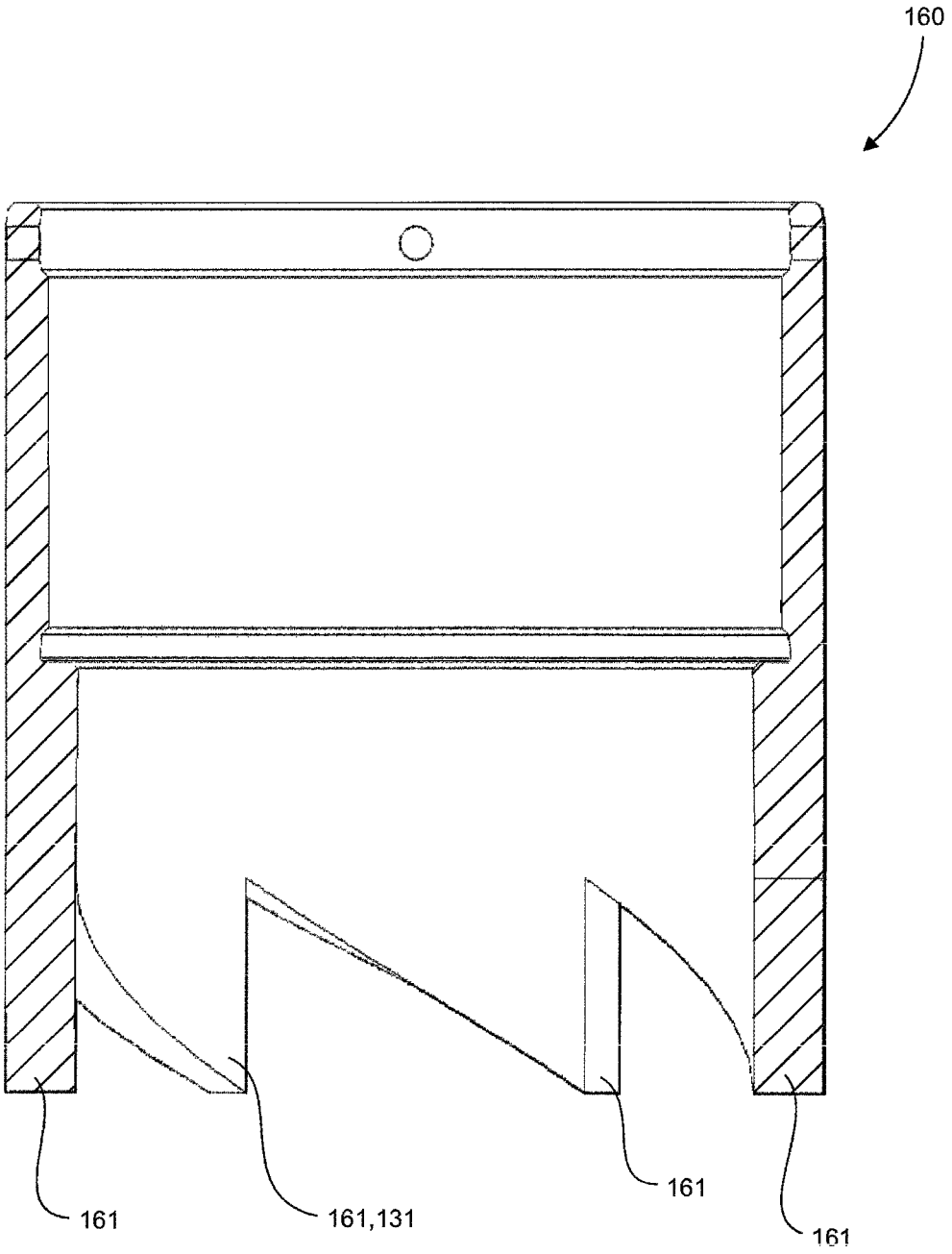
FIG. 12 is a sectional view of the tubular bit of FIG. 1.
Figure 13:
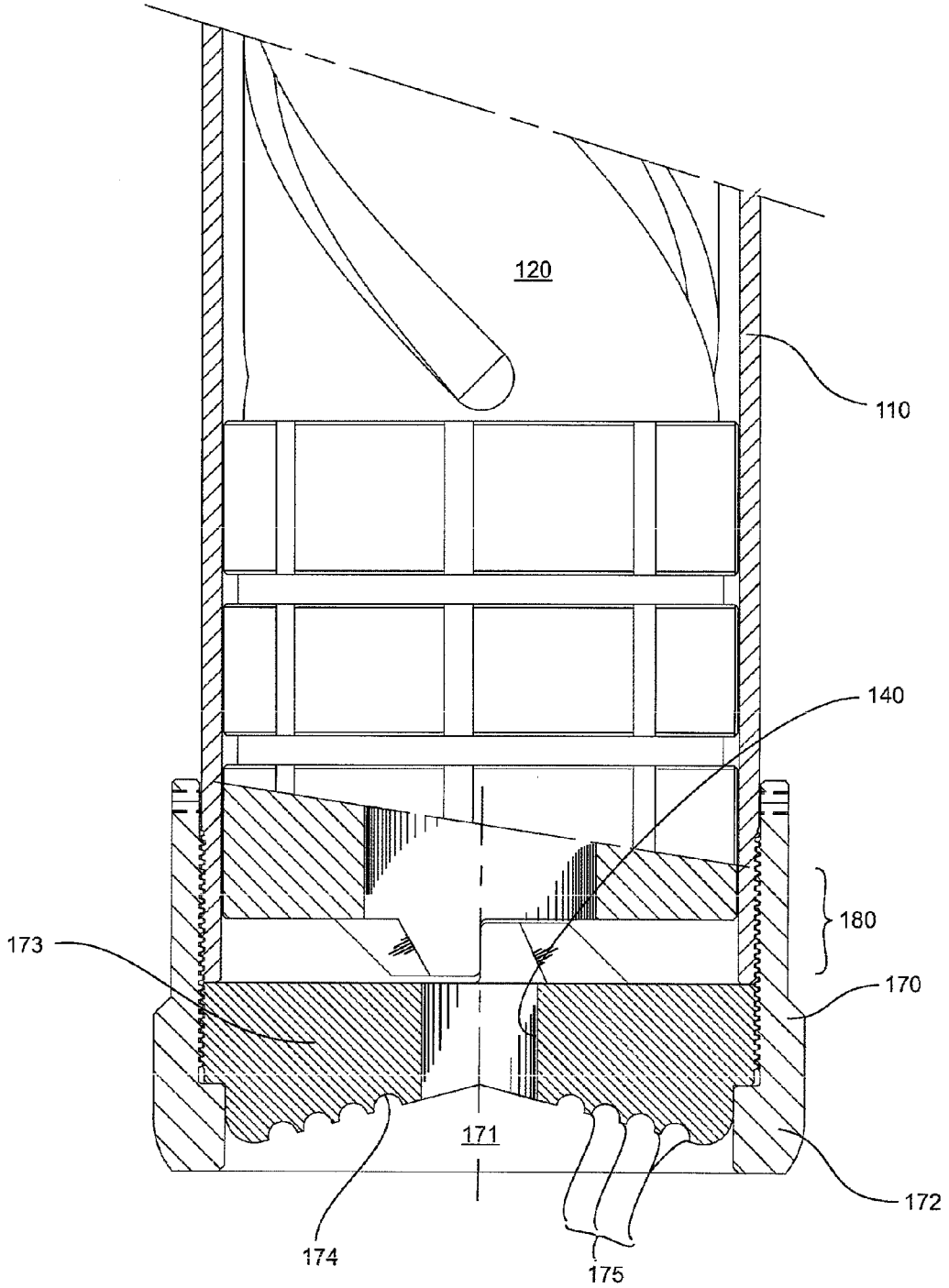
FIG. 13 is a longitudinal partial sectional view illustrating an embodiment of a drill-throughable bit having a less competent bit insert and a locking mechanism between the mandrel (shown in side view) and the bit at the downhole end of the sleeve (shown in section)
Figure 14:
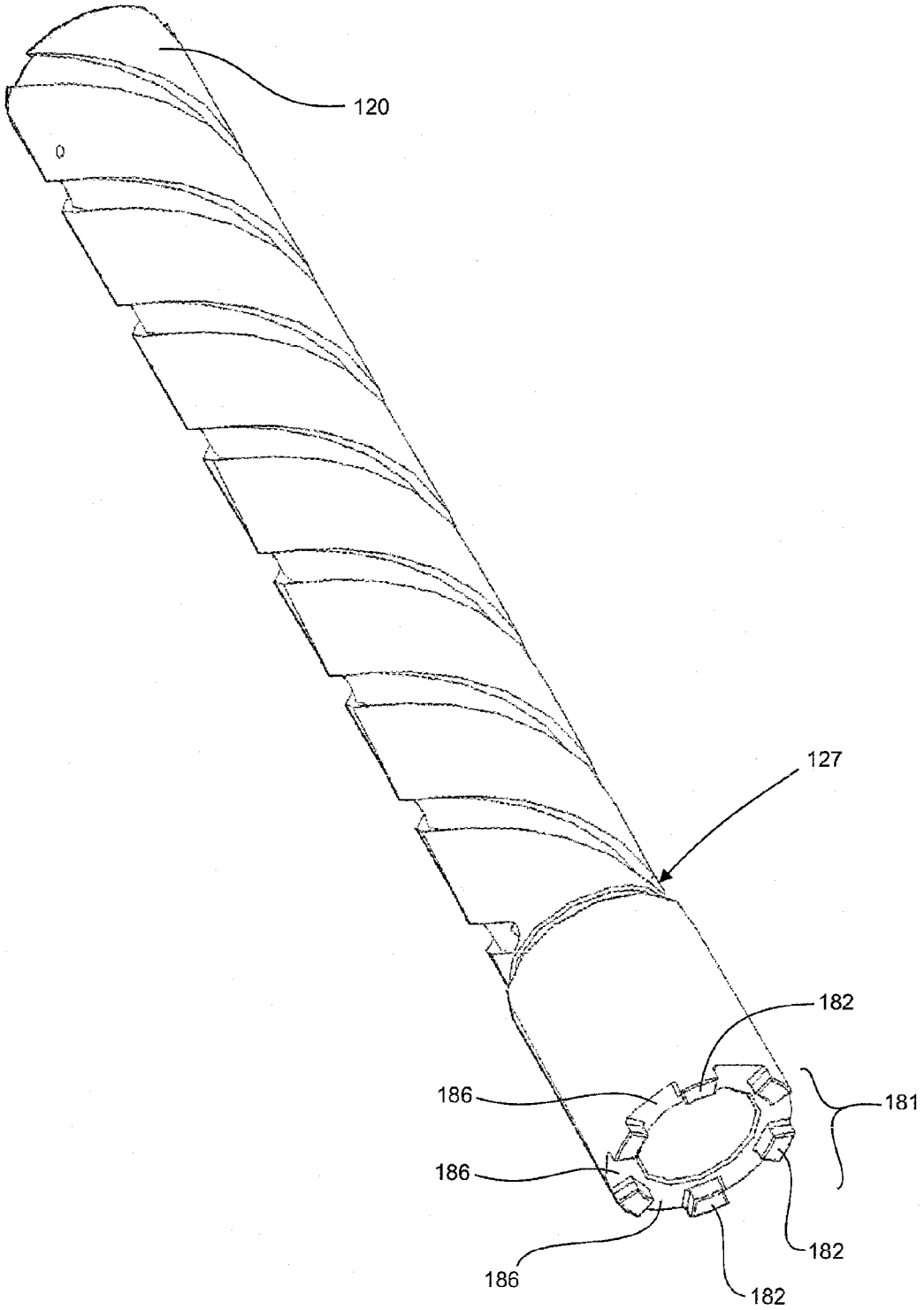
FIG. 14 is a perspective view of an embodiment of the mandrel having a first castellated profile at a downhole end for forming a locking mechanism.
Figure 15:
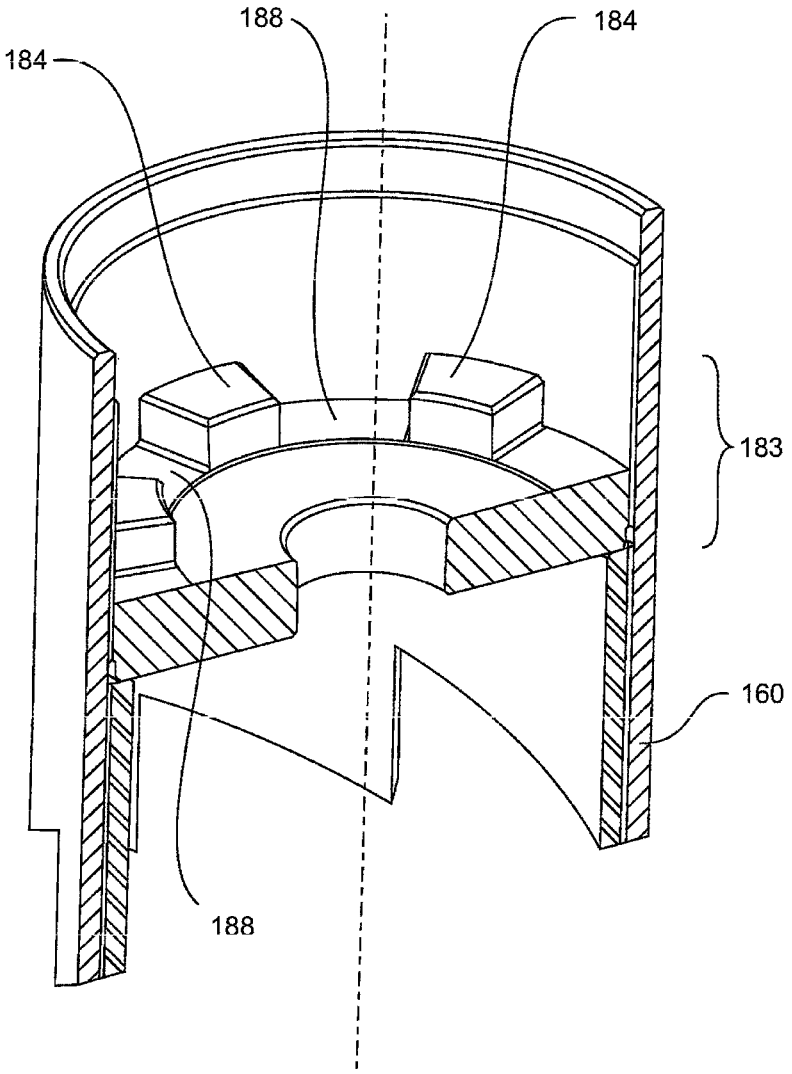
FIG. 15 is a perspective sectional view of a downhole end of the sleeve, illustrating a tubular bit having a second castellated profile for correspondingly interlocking with the first castellated profile of FIG. 14 to form a locking mechanism.

Similarly, as shown in FIGS. 7, 12 and 13 the protrusions 131 can be various forms of teeth 161. The plurality of protrusions 131 or teeth 161 are positioned circumferentially about the downhole end 112 of the sleeve 110. As shown FIG. 1, the plurality of protrusions 131 can be generally offset from one another, such as radially set, or opposingly oriented circumferentially, or both, to aid in engaging and agitating obstructions, aiding in the erosion thereof. Further turbulence aids in keeping the debris from settling out of the fluid F so as to lift the debris with the fluid F to surface.

With reference to FIGS. 5 to 12, and in an embodiment, the protrusions 131 are provided by mechanical means, such as conventional cutters or teeth 161, on a drill bit 150 fit to the downhole end 112 of the sleeve 110. The drill bit 150 has one or more openings 151 therein for discharging the fluid F therefrom.

Figure 8:
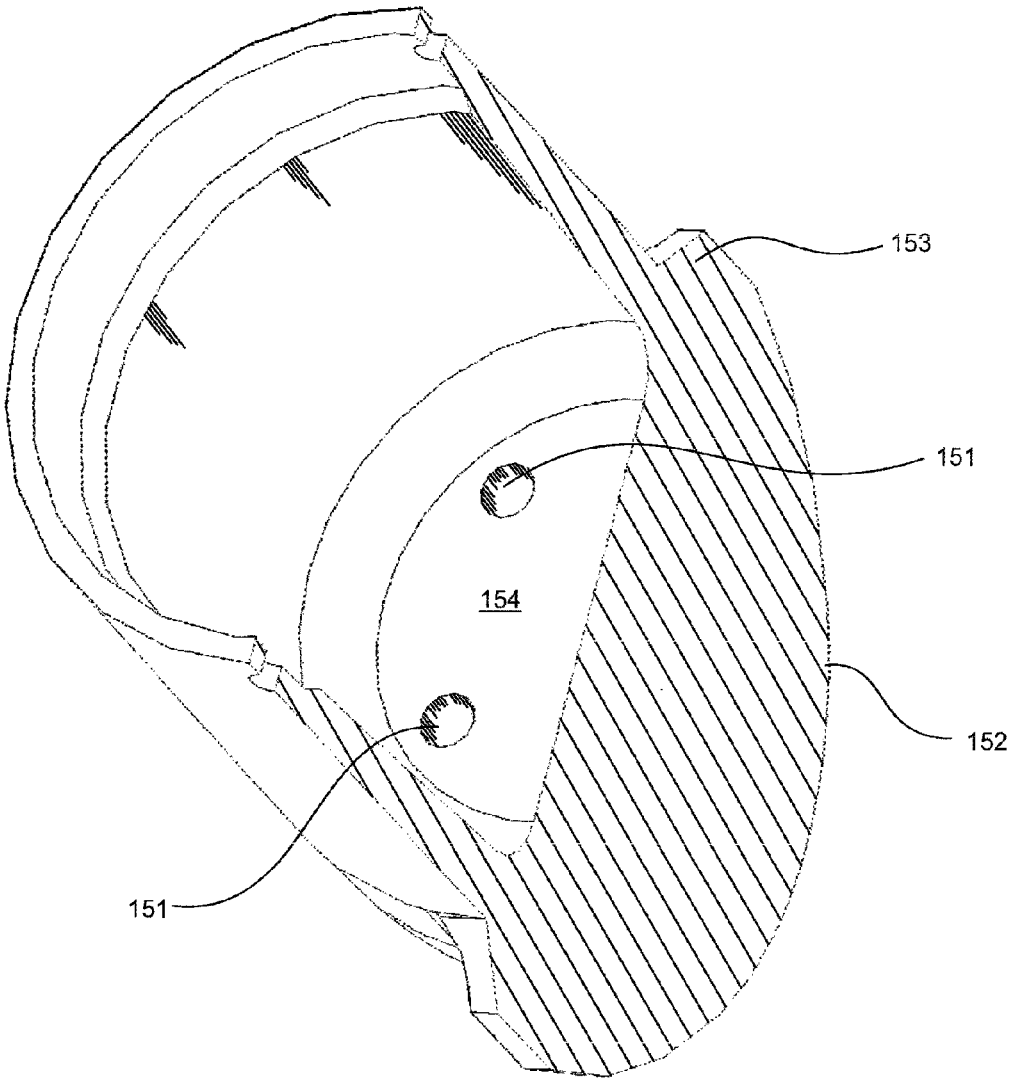
FIG. 8 is a perspective sectional view of the bit according to FIG. 7, showing an uphole face and the plurality of openings for fluid passage.

As shown in FIGS. 7 and 8, and in an embodiment, the drill bit 150 is a PDC-equipped drill bit comprising a tapered or bullet-shaped leading surface 152 and PDC cutter elements 153. A tapered or bullet contoured leading surface 152 aids in tracking of the wellbore such as in horizontal wells. The leading surface 152 of the drill bit further comprises at least one opening 151 for permitting fluid F to pass therethrough from the sleeve bore 115 to the annulus 20. The at least one opening 151 functions similarly to the flow restrictor 140 and acts to restrict the flow of the fluid F passing therethrough for increasing the velocity of the fluid F. Further, an uphole face 154 created by the leading surface 152 aids in increasing the backpressure acting thereon for extension of the sleeve 110 to the extended position.

With reference to FIGS. 9A-12, the drill bit 150 is a tubular drill bit 160 having an open bore 162 which is contiguous with the sleeve bore 115 for delivery of fluids F therethrough and a plurality of teeth 161 (FIGS. 11 and 12) extending downwardly therefrom for forming the protrusions 131. The tubular drill bit 160 further comprises flow restrictor 140. The flow restrictor 140 is positioned within the bore 162 for increasing the velocity of the fluids passing therethrough and provides uphole surface 154 for hydraulically extending the tubular sleeve 110.

In the case of horizontal wellbores 14, the teeth 161 formed about the open bore 162 can engage and ream the wellbore 14. An alternate embodiment of bit 179 is shown in FIG. 13.

In some embodiments, there may be an objective to drill through the obstruction-clearing tool 100. In a conventional casing operation, casing is advanced into the wellbore 14 until the casing 10 is landed at the target depth. The casing 10 is cemented into place. In embodiments, for use where there is no expectation to extend the wellbore 14 after cementing the casing 10, the obstruction-clearing tool 100 is manufactured of robust 4140 steel.

In embodiments, for use where the depth of the wellbore 14 is to be extended following cementing of at least a first section of casing 10, at least portions of the obstruction-clearing tool 100 are made to be drillable. Due to the nature of the tool 100 to have relative rotatable components, accommodations are made to avoid reactive rotation of one or more portions of the tool 100 when drilling through the tool 100.

Generally, the drillable portions are made of less competent materials, such as aluminum and aluminum composites, which facilitate being drilled out. In such cases, the portions that are made drillable are generally internal components which would otherwise interfere with or retard passage of a drill string therethrough. The bit 150 can also be drillable or its design accommodates passage of a drill string therethrough, such as in the tubular drill bit 160 embodiment of FIG. 12, which minimally obstructs the bore 115 of the sleeve 110.

For example, the mandrel 120 may be formed of aluminum and the guide pins 111 may be made of bronze while the remaining components such as the sleeve 110 are made of 4140 steel. The bit 150 is also made of less competent materials permitting drilling therethrough.

In an embodiment, shown in FIG. 13, a drillable bit incorporates robust characteristics used for engaging and clearing the wellbore obstructions 119, yet permits drilling out for passage of a subsequent drill string therethrough for extending the wellbore 14 beyond the initial target depth. The bit 150 comprises a tubular bit body 170 made of robust steel construction including polycrystalline diamond compact (PDC) cutter elements (not shown), which are not readily drilled through. The tubular bit body 170 has a bit bore 171 formed therein through which the drill string may pass, the bit 170 body being substantially avoided. A less competent bit insert 173 is fit within the bit bore 171, the bit insert 173 having a leading bit surface 174 comprising the plurality of protrusions 131 such as teeth of cutters 175 formed thereon. The plurality of cutters 175 engage the obstructions 119 much like the protrusions 131 and drill bits 150, 160 of the previously described embodiments. The bit insert 173 further forms the flow restrictor 140, as previously described both for increasing the velocity of fluid F discharged therefrom and for hydraulic extension of the sleeve 110.

The bit body 170 is manufactured from robust 4140 hardened steel. The bit insert 173 and the flow restrictor 140 are manufactured from 6061 aluminum, which is suitable to withstand the rigors of the casing stroking operation yet are drillable.

The drillable embodiment of the obstruction-clearing tool 100 is connected to the downhole end 11 of the casing 10 and casing 10 is lowered to the target depth, the obstruction-clearing tool 100 acting as a landing tool. The casing 10 is thereafter cemented into with wellbore 14 using conventional cementing operations. Cement is pumped through the casing 10 and is discharged from the downhole end 112 of the sleeve 110 and into the annulus 20. The cement hardened about the sleeve 110 prevents any further axial or rotational movement of the sleeve 110 about the stationary mandrel.

In drill-through operations, a secondary drill string and drill bit can damage or drill out the helical drive connection between the mandrel 120 and the sleeve 110. Free rotation of the mandrel ahead of the secondary drill string nullifies the drilling operation. Several features are provided in one or more embodiments, to minimize problems when drilling through the tool 100.

In one embodiment, shown in FIGS. 13-16, a locking mechanism 180 connects between the mandrel 120 and sleeve 110 in the fully retracted position, preventing independent rotation of the mandrel 120 should the connection between the mandrel 120 and the casing 10 and the mandrel 120 and the sleeve 110 be compromised. As shown in greater detail in FIGS. 14 and 15, the locking mechanism 180 is an interlocking interface, such as a castellated interface, between the downhole end 127 of the mandrel 120 and the downhole end 112 of the sleeve 110 for interlocking the components and preventing relative rotational movement therebetween. The downhole end 127 of the mandrel 120 comprises a first castellated profile 181 (FIG. 14) having a plurality of circumferentially-spaced axially-extending projections 182 formed thereon and a plurality of recesses 186 therebetween. Similarly, the downhole end 112 of the sleeve 110 comprises a second castellated profile 183 (FIG. 15) having a plurality of circumferentially-spaced, axially-extending projections 184 formed thereon and a plurality of recesses 188 therebetween. In an interlocked position, with the first and second castellated profiles 181, 183 being face-to-face, the projections 182 of the first castellated profile 181 are engaged in the recesses 188 of the second castellated profile 183. Accordingly, the projections 184 of the second castellated profile 183 are engaged in the recesses of the first castellated profile 181. In the interlocked position, the mandrel 120 is prevented from rotating.

The mandrel 120 and the sleeve 110 may not be in the interlocked position when the drilling operation begins, such as when the sleeve 110 is in the axially extended position when cemented in. In such instances, when the mandrel 120 becomes free to rotate with the drill string, the remaining portion of the mandrel 120 having the first castellated profile 181 is pushed downhole by the secondary drill string. The first castellated profile 181 is caused to engage with the second castellated profile 183 of the sleeve 110 in the interlocked position preventing further rotational movement of the mandrel 120 and permitting the drilling operation to continue.

Figure 16:
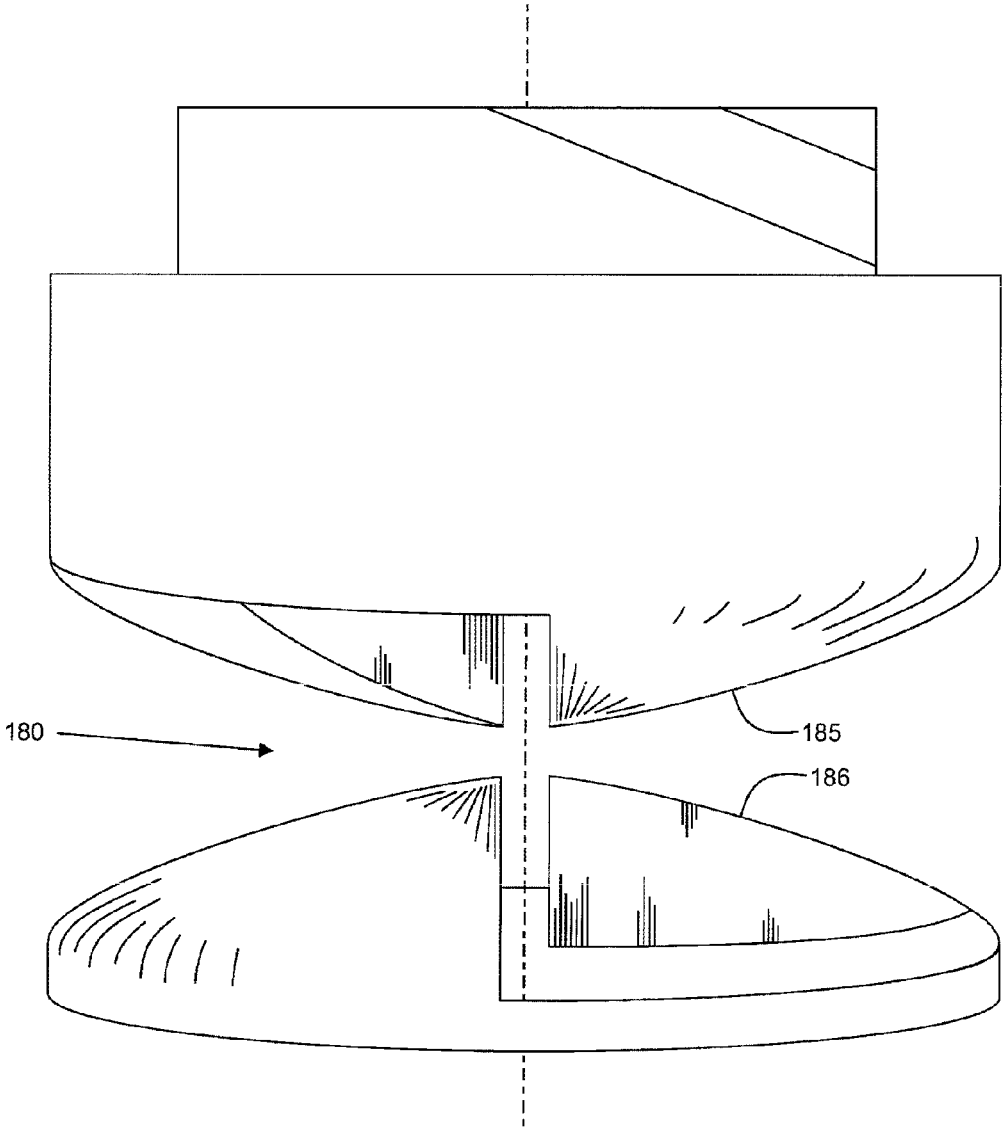
FIG. 16 is a perspective view of an alternative form of a locking mechanism comprising a screw head-type interlocking interface.

In an embodiment as shown in FIGS. 13 and 16, the locking mechanism 180 comprises a uni-directional, screw-head-type interlocking cog-like interface having cooperating and rotationally ramped axial faces 185, 186 for arresting co-rotation of the mandrel 120 during drilling out.

In an embodiment which minimizes deviation of the extended wellbore when drilling through the tool, the mandrel and sleeve are provided with a casing shell 190 which guides the second drill through the tool 100.

Figure 17A:
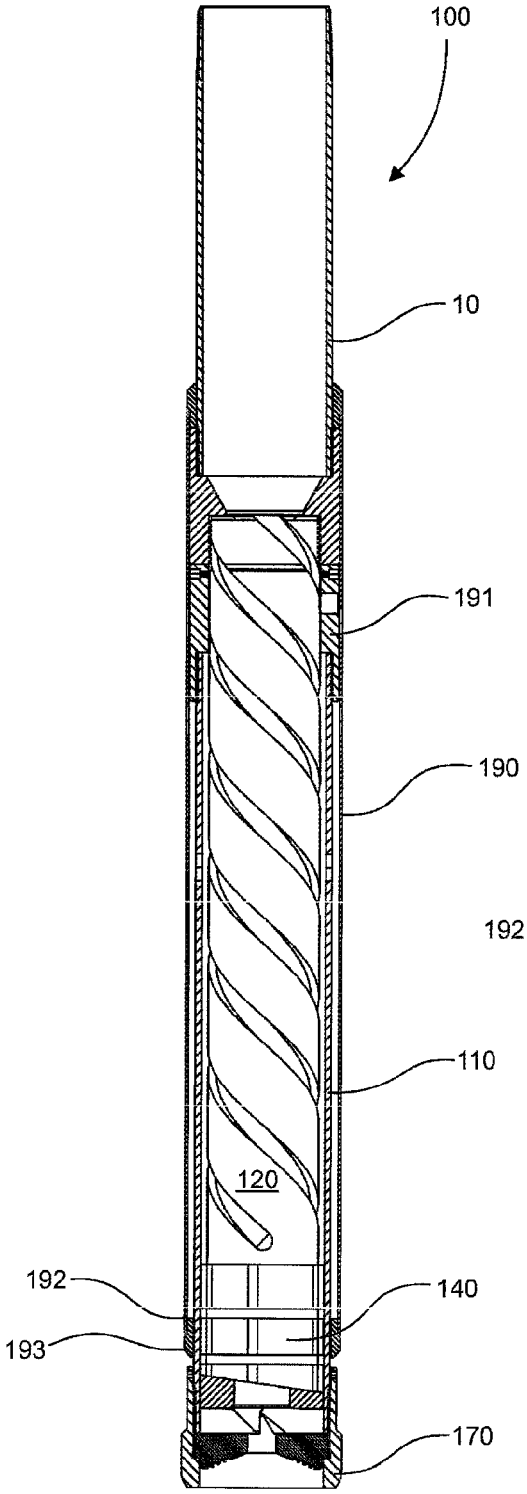
FIG. 17A is a longitudinal partial sectional view of the embodiment of FIG. 13 illustrating a drill-throughable wellbore obstruction-clearing tool having a casing shell extending over the mandrel (is seid view) and the sleeve (in sectional view), the sleeve being in the retracted position.
Figure 17B:
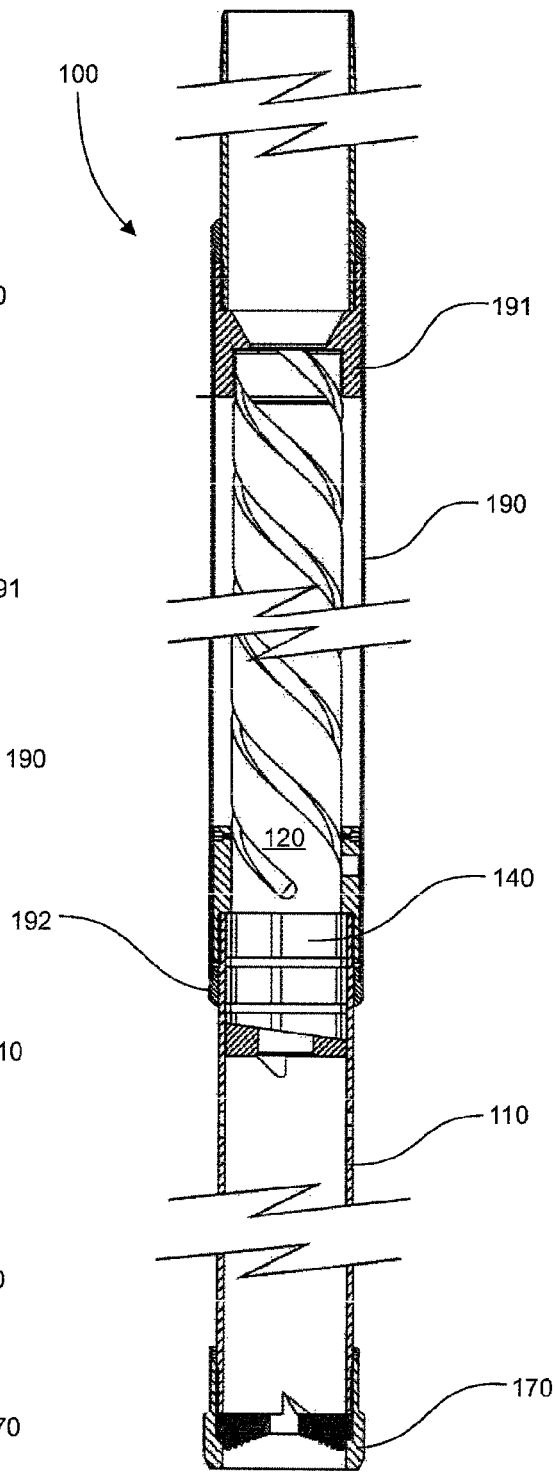
FIG. 17B illustrates the sleeve of FIG. 17A its fully extended position and the casing shell surrounding the mandrel for providing a guide for a subsequent pr secondary drill string.

Having reference to FIGS. 17A and 17B, an obstruction-clearing tool 100 having a drillable bit 170, further comprises a casing shell 190 manufactured from materials that are resistant to drilling or milling, such as 4140 hardened steel. The casing shell 190 shields the mandrel 110 for guiding the second drill string along a drilling path substantially in alignment with the mandrel 120 and into the sleeve 110. The casing shell 190 is fit concentrically over the mandrel 120, and concentrically and slidably over the sleeve 110, and extends along a length of the mandrel 120 from about the mandrel's upper end 128 to the mandrel's downhole end 127. The casing shell 190 is secured to the mandrel's upper end 128 by an upper collar 191 and slidable over the sleeve 110. The casing shell 190 is stationary with the mandrel 120 during axial extension of the sleeve 110. A downhole end 192 of the casing shell 190 is slidably and rotatably stabilized about the sleeve 110 by a downhole collar 192. As shown in FIG. 17B, the sleeve 110 passes through the downhole collar 192 when the sleeve 110 is axially extended, the casing shell 190 remaining substantially surrounding the mandrel 120.

As one of skill in the art will appreciate, the obstruction-clearing tool 100 can be sized appropriately depending upon the size of the casing 10 being utilized. That is, the obstruction-clearing tool 100 can be adapted to operatively and fluidly connect to tubulars commonly used in the industry, such as 4½ inch, 5½ inch, 7 inch, or 9⅝ inch casings and 2⅞ inch coiled tubing, or can be custom sized for any size casing 10 or CT.

As shown in FIGS. 5 and 6A to 6C, an obstruction-clearing tool 100, particularly suited for use in vertical wellbores with 5½ inch casing 10, comprises a mandrel 120 having a diameter of about 4.25 inches and a length of about 68 inches (about 1.73 m) and a sleeve 110 having a length of about 92 inches (about 2.34 m). The sleeve 110 has an inside diameter of about 4.89 inches (about 12.42 cm) forming a clearance fit concentrically about the mandrel 120 and an outside diameter of about 5½ inches (13.97 cm). Three, 1 inch (about 2.43 cm) diameter guide pins (not shown) are provided at about 120 degrees apart for engaging three parallel and helical grooves 122 in the mandrel 120. Annular seals 124, 126, such as rubber cushions or large O-rings, are fit about the mandrel's uphole end 128 and downhole end 127 as cushions between the mandrel 120 and sleeve 110 when the sleeve 110 bottoms at each end of the stroke. The resulting stroke of the obstruction-clearing tool 100 is about 68.5 inches or about 5 feet (1.52 m) the sleeve 110 rotating approximately 4.9 revolutions about the mandrel 120 per stroke.

Figure 9A:
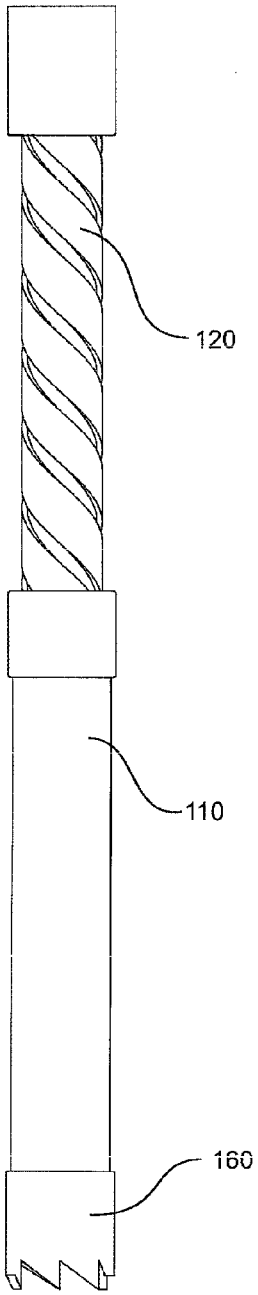
FIGS. 9A, 9B and 9C illustrate another embodiment of an obstruction-clearing tool which is optimized for horizontal wellbores and drillable embodiments.
Figure 9B:
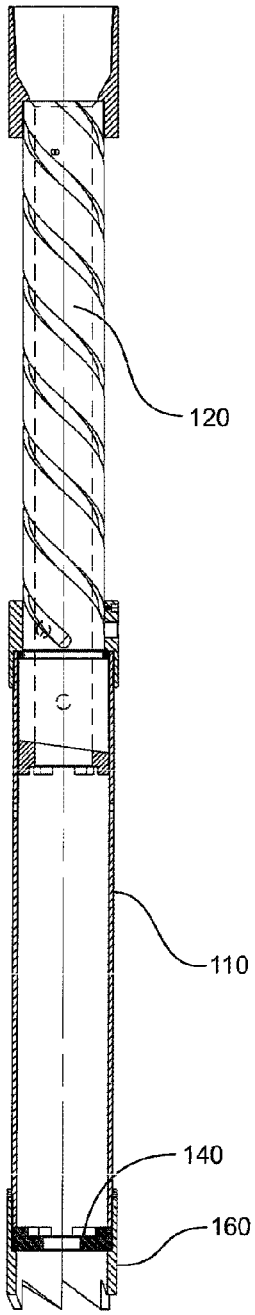
Figure 9C:
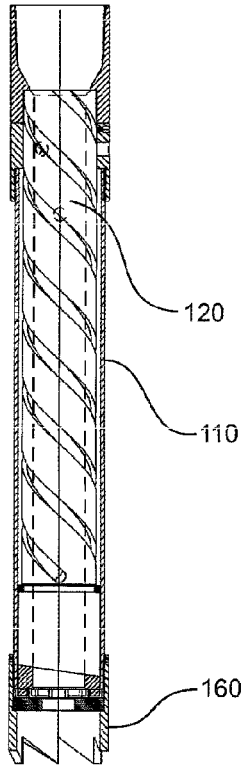

With reference to FIGS. 9A to 9C, 10A to 10C, 11 and 12, an embodiment well-suited for passing through and cleaning deviated or horizontal wellbores is shown. In FIGS. 9A to 9C, a shorter or stubby embodiment comprises a mandrel 120 having a length of about 32 inches (about 81.28 cm) a corresponding sleeve 110 having a length of about 54.38 inches (about 1.38 m). When sized for use with a 7 inch casing, the mandrel 120 has a diameter of about 5.7 inches (about 14.48 cm) and the sleeve 110 has an outside diameter of 7 inches (about 17.78 cm) and an inside diameter of about 6.37 inches (about 16.18 cm). The stroke length is about 32 inches (81.28 cm) and the sleeve 110 makes about 2 revolutions about the mandrel 120 per stroke.

In Operation

Embodiments of the wellbore obstruction-clearing tool 100 are used during casing of an open hole or wellbore 14 which has been drilled in a previous drilling operation. A survey can log obstructions, including tight spots, requiring clearing. The wellbore obstruction-clearing tool 100 is connected to a bottom of a joint of conventional casing and the casing is run into the wellbore.

Some operators prefer to remove the shipping or shear pin or pins 129 and run the tool 100 in extended, possibly operating passively and periodically on the trip downhole. In other cases the shear pin or pins 129 remain in place to retain the sleeve 110 in the retracted position during tripping into the wellbore 14.

Figure 18:
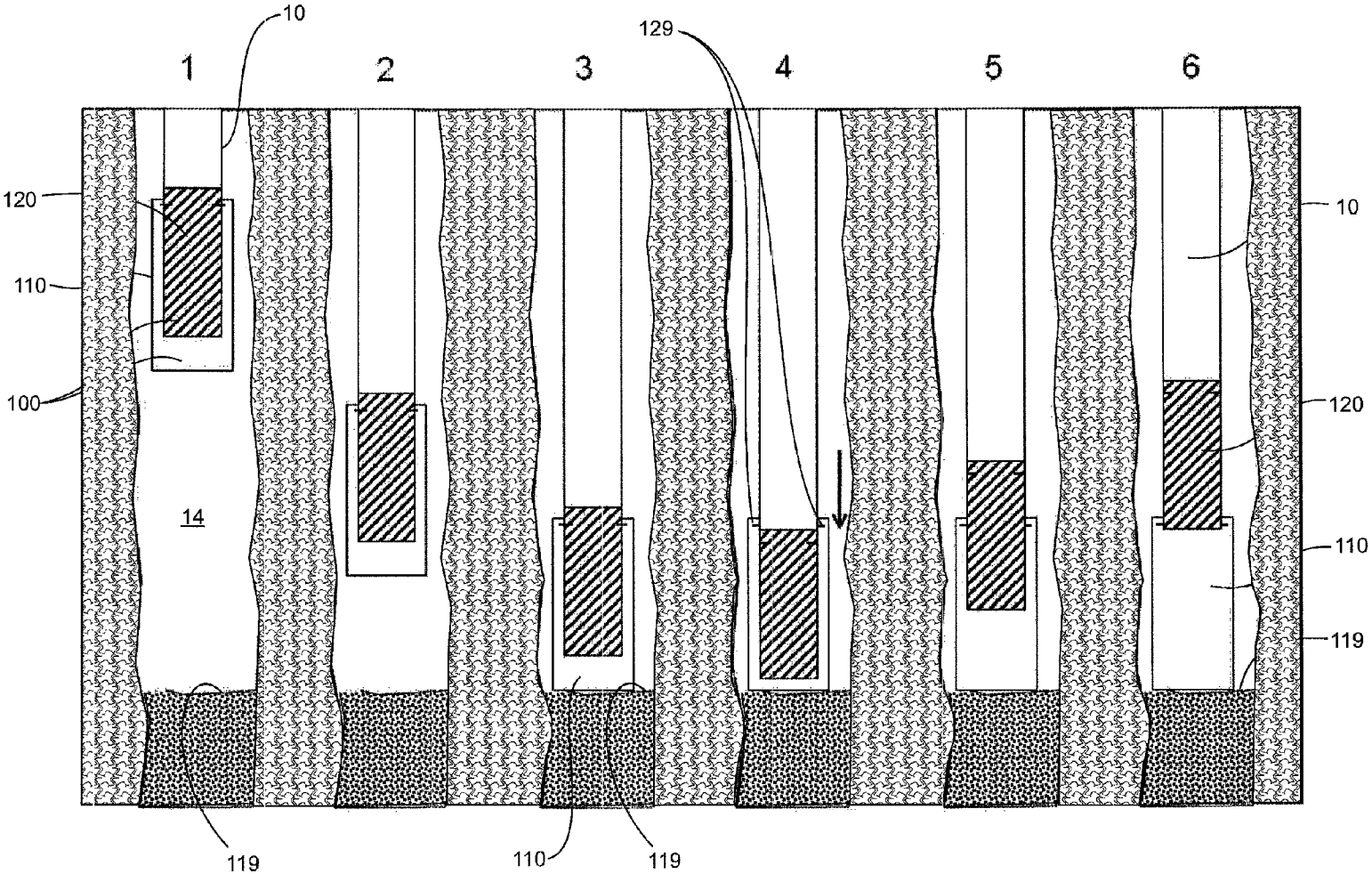
FIG. 18 is a schematic representation illustrating a six-step progression of a wellbore obstruction-clearing tool engaging an obstruction in a vertical wellbore and being activated by shearing of shear pins.

As shown in FIG. 18, with the shear pins 129 in place, and in a vertical wellbore, the casing 10 and tool 100 are lowered into the wellbore at (1) and (2) to an obstruction 119 at (3). A downhole shear force, such as a downhole set-down load of about 1000 lbs, is applied to the tool 100 at (4), sufficient to shear the shear pins 129, permitting the sleeve 110 to be free to move relative to the mandrel 120.

Once the sleeve 110 is free to move axially and rotationally relative to the mandrel 120, the casing 10 and mandrel 120 are lifted or stroked uphole at (5) with sleeve 110 moving rotationally towards its extended position. The casing is stroked upwardly and the sleeve 110 reaches the extended position at (6). The stoke of the casing can be controlled and is not necessarily stroked to the full extension or the full retraction.

The stroking of the casing 10 continues uphole and downhole so as to drive the tubular sleeve to rotate and reciprocate axially between the retracted position and the extended position for engaging the wellbore obstruction, creating debris and is repeated until the obstruction is cleared and the tool 100 can be landed at target depth, or the next obstruction.

In a vertical wellbore, extension of the sleeve 110, as the mandrel 120 is stroked uphole, is largely under the influence of gravity and thus lifting of the casing 10 may be sufficient to cause the sleeve 110 to extend. Fluid F is typically used as well for removal of debris and for extension of the sleeve 110.

Figure 19:
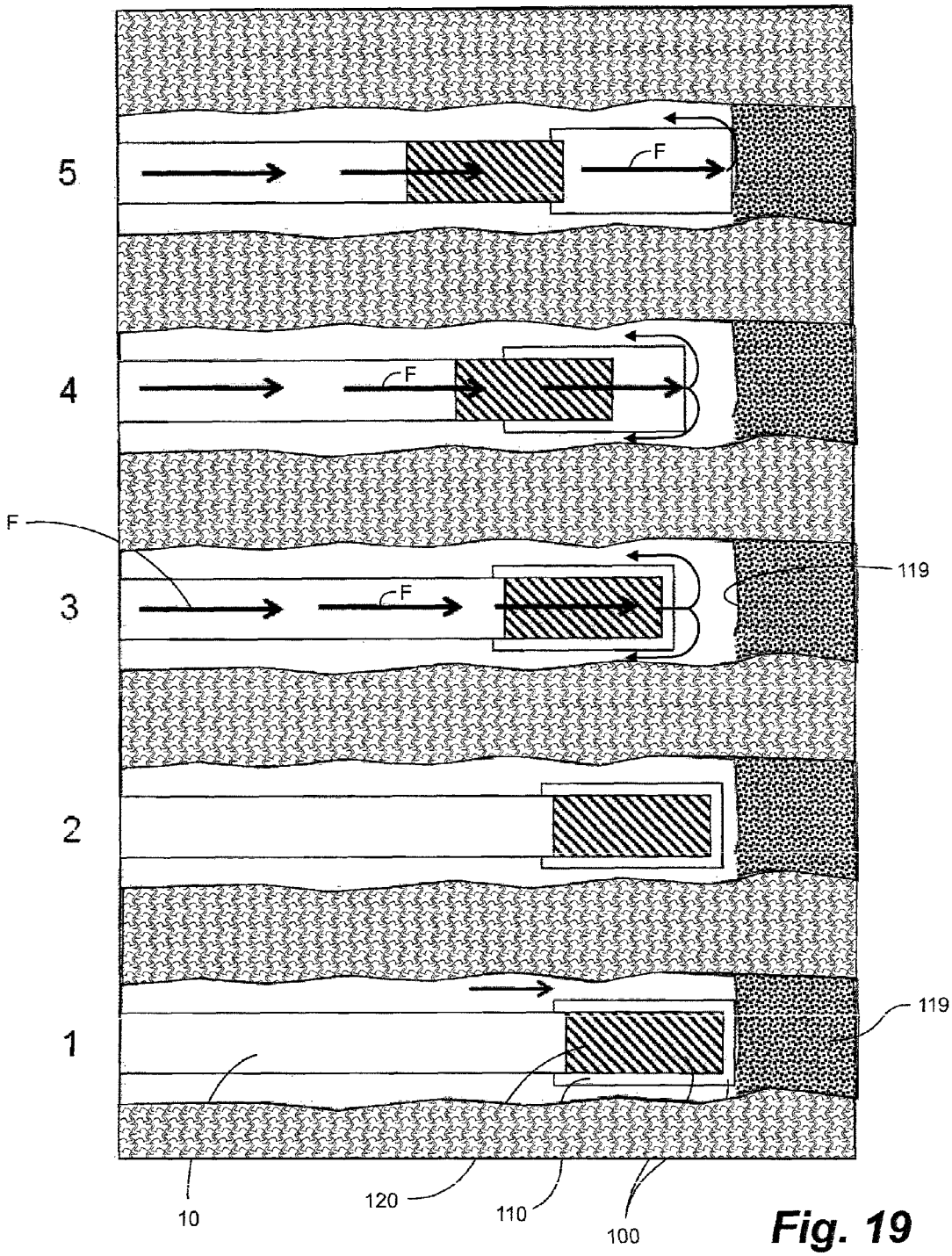
FIG. 19 is a schematic representation illustrating a five-step progression of a wellbore obstruction-clearing tool engaging an obstruction in a horizontal wellbore, the sleeve being axially extended through fluid hydraulics.

With reference to FIG. 19, in a horizontal wellbore where gravity provides no gravitational impetus for the sleeve 110 to extend along the mandrel 120, the fluid F hydraulically extends the tubular sleeve to the extended position as the tubing string is stroked uphole. In this case, as the casing 10 is stroked uphole at (3), the fluid F forces the sleeve 110 to remain downhole, while rotating and may be engaged against the obstruction 119.

Figure 20:
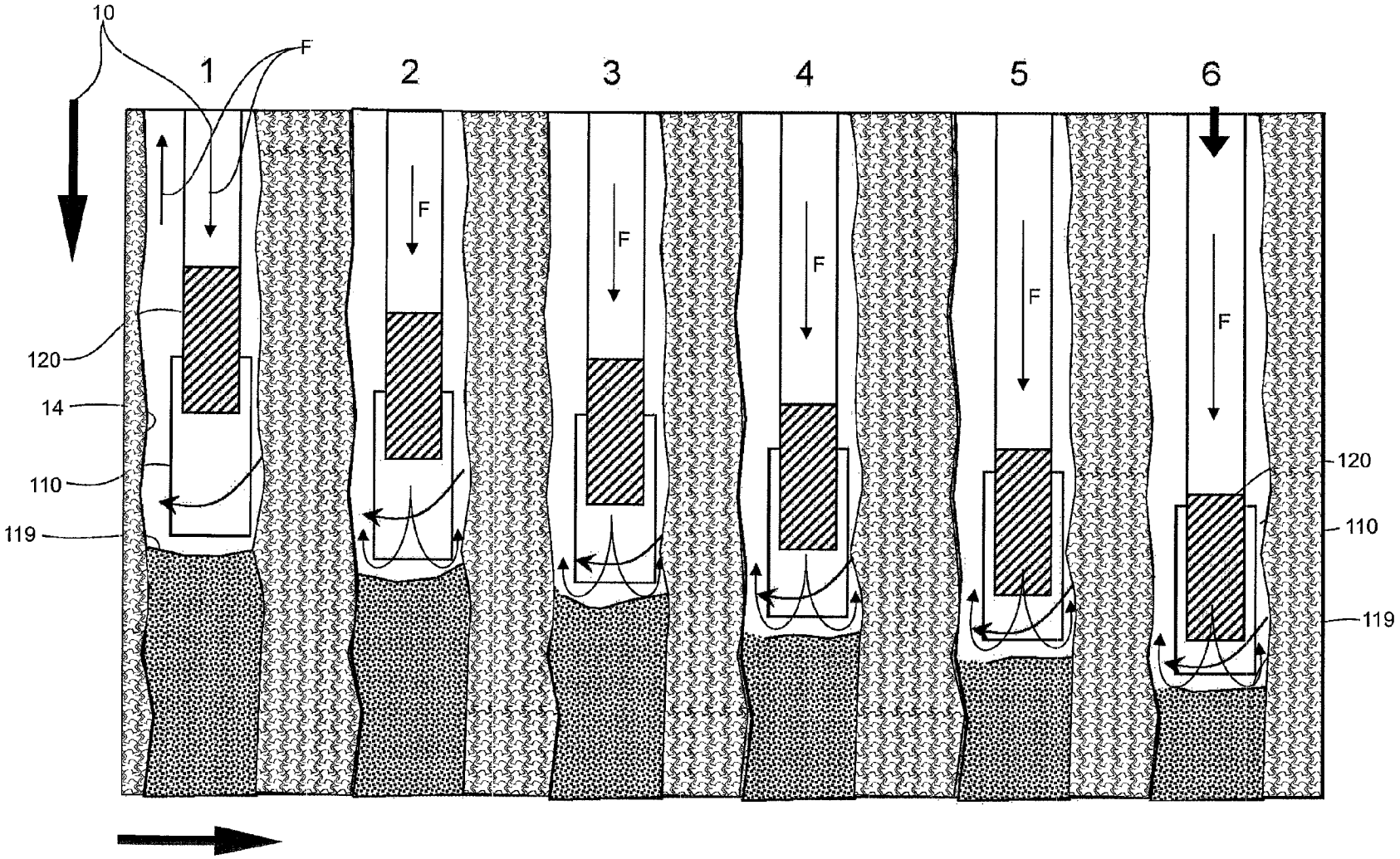
FIG. 20 is a schematic representation illustrating a six-step, left-to-right progression of a downstroke of the casing and wellbore obstruction-clearing tool acting against an obstruction in a vertical wellbore.

With reference to FIG. 20, in a typical clearing operation as shown from left to right, whether the wellbore 14 is vertical or horizontal, the casing 10 is stroked downhole from an extended position at (1) to a retracted position at (6). The stroking of the casing and mandrel 120 causes the sleeve 110 to axially and rotationally retract along the mandrel 120. The rotation of the sleeve 110 engages the obstruction 119 and creates debris therefrom. The fluids F circulated uphole through the annulus 20 convey the debris to surface.

Figure 21:
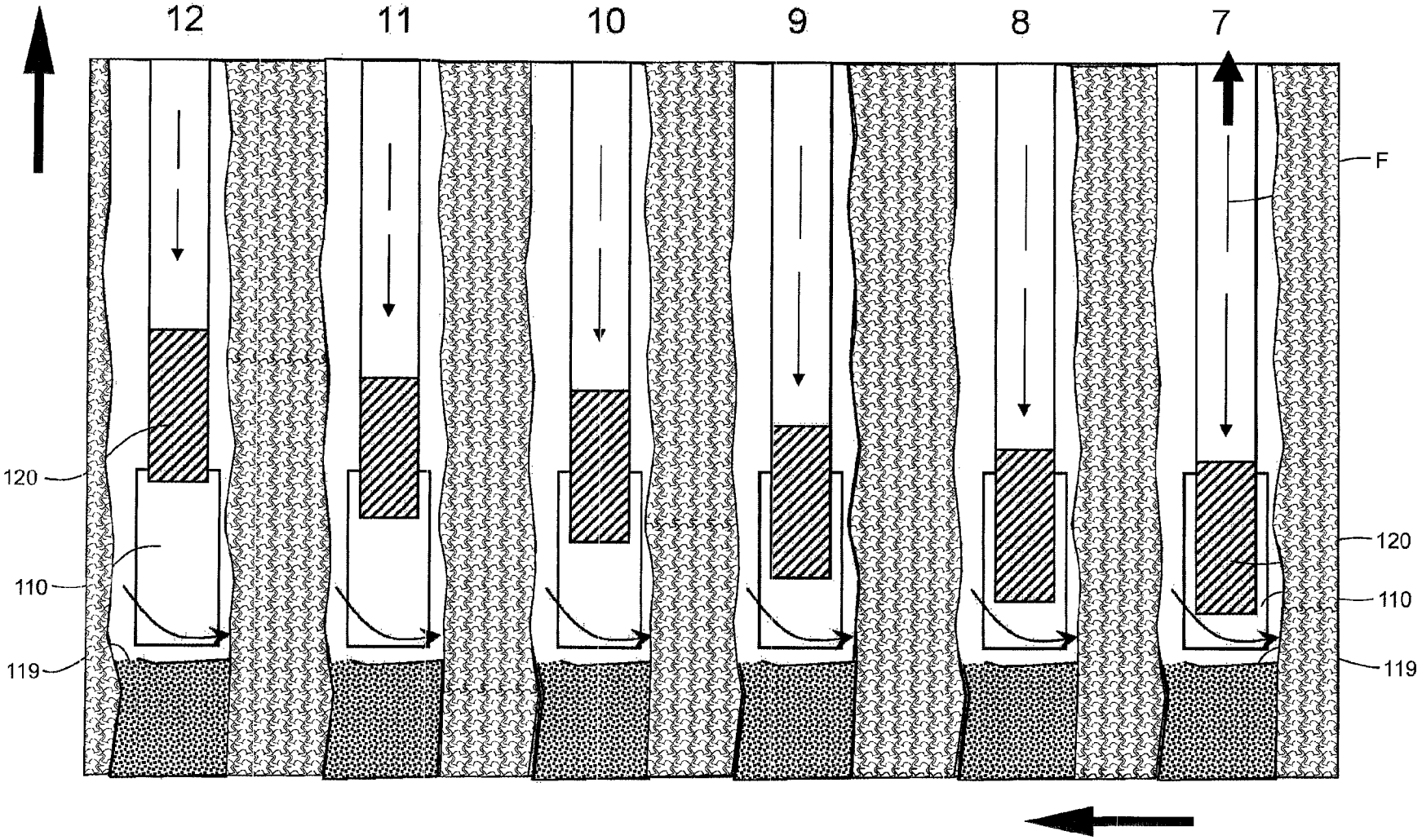
FIG. 21 is a schematic representation illustrating a six-step, right-to-left progression of an resetting, upstroke of the casing and wellbore obstruction-clearing tool.

Thereafter, as shown from right to left in FIG. 21, and beginning with the tool at the retracted position at step (7), the casing 10 and mandrel 120 are lifted clear of any remaining obstruction 119. As shown in steps (8) through (12), as the sleeve 110 extends along the mandrel 120 the sleeve 110 rotates in the opposite direction to that when the sleeve is retracted along the mandrel 120. The sleeve 110 resets for a subsequent downstroke of FIG. 20, but also continues to rotate and discharge fluid F for engaging the obstruction.

The operation of FIGS. 20 and 21 is repeated as many times as is necessary to clear the obstruction 119, and for each and any subsequent obstructions, sufficient that the casing 10 can be advanced thereby until the casing 10 reaches the target depth. As will be appreciated by those of skill in the art the tool 100 according to embodiments of the invention acts as a casing landing tool. Thereafter, such apparatus as may be required to cement the casing into the wellbore is run into the casing 10.

Figure 22A:
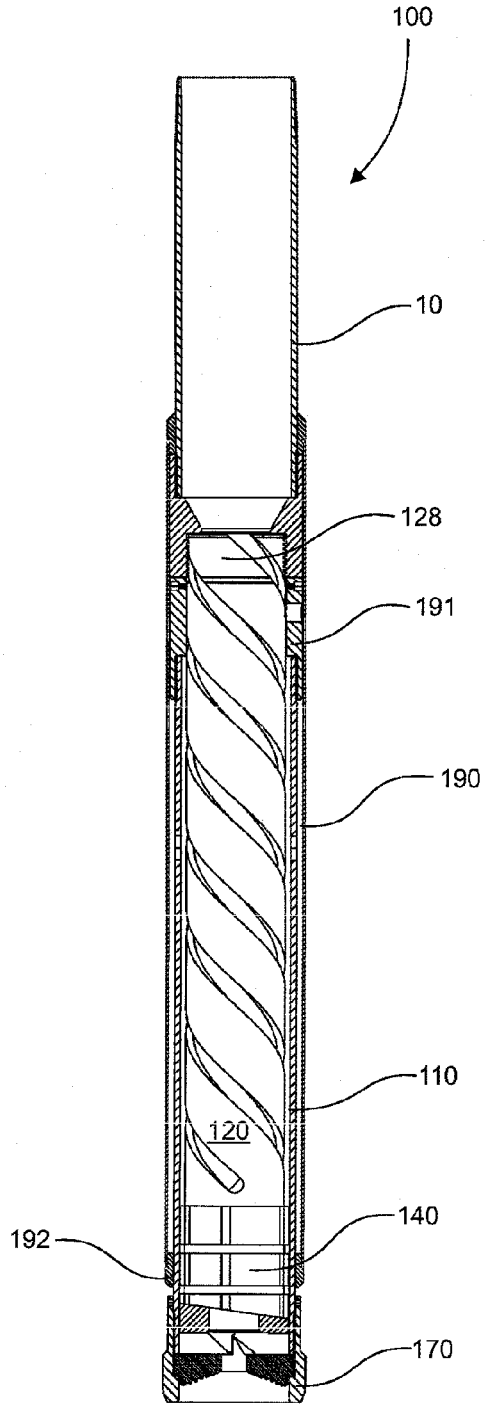
FIGS. 22A and 22B are schematic representations of a drill-throughable tool according to FIG. 17A, which is cemented in a wellbore and then being drilled out by a secondary drill string respectively, for extending a previously cased wellbore.
Figure 22B:
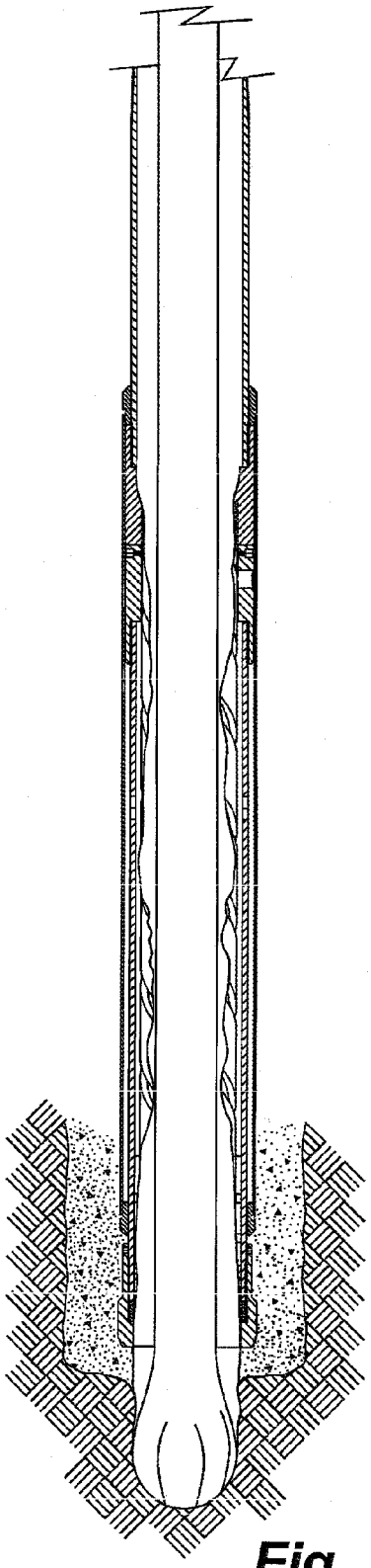

With reference to FIGS. 22A and 22B, in a drillable embodiment using a form of tool 100 set forth in FIGS. 17A and 17B, a length of a wellbore 14 is extended, As secondary drill string 200 and drill bit 201, has an outer diameter smaller than the inner diameter of the sleeve 110. At least a portion of the mandrel 120, the bit 150 and the flow restrictor 140 are drilled through for gaining access to the formation below the previously cased wellbore 14 and drilling an extension of the wellbore therein.

EXAMPLE

An embodiment of the invention was tested during casing of a vertical wellbore in which normal casing operations were first attempted and had failed. Obstructions were encountered at about 1 kilometer downhole preventing passage of the casing to the target depth.

Previously, a drilling fluid was circulated through the casing and adjacent the obstructions in an attempt to hydraulically clear the obstruction. The process lasted three successive days, at great expense, and was ultimately unsuccessful in clearing a first obstruction. The casing was tripped out and a mud motor was run downhole to mechanically drill through the first obstruction. The conventional mandrel, drill bit and bottom sub of the expensive mud motor were eventually lost downhole without successfully clearing the first obstruction. The bottom sub of the mud motor was eventually recovered by a fishing operation. Several weeks were lost and the first obstruction was still not cleared.

Thereafter, an obstruction-clearing tool 100 was operatively and fluidly connected to the casing and run downhole. The obstruction-clearing tool was actuated when the first obstructions was reached. The casing and the tool were stroked fully, uphole and downhole, three times. The obstruction was successfully cleared and the casing advanced thereby.

The embodiments of the invention for which an exclusive property or privilege is claimed are defined as follows:

1. A wellbore obstruction-clearing tool, fit to a downhole end of a tubing string for advancing the tubing string through obstructions in a wellbore, the tubing string having an axial bore therethrough for communicating fluids to an annulus between the tubing string and the wellbore for circulation to surface, the tool comprising:

an inner tubular mandrel for connection to the downhole end of the tubing string, the mandrel having a mandrel bore extending axially therethrough, the mandrel bore being fluidly connected to the axial bore;

an outer tubular sleeve rotatable about the inner tubular mandrel and extendable therealong having, a sleeve bore extending axially therethrough and fit concentrically fit about the mandrel, the sleeve bore being fluidly connected with the mandrel bore, and a downhole end for engaging the wellbore obstructions; and a helical drive arrangement acting between the mandrel and the sleeve for permitting reciprocating downhole and uphole axial movement of the inner tubular mandrel within the outer tubular sleeve to drive the outer tubular rotationally in the first direction about the mandrel towards a retracted position and driving the outer tubular sleeve rotationally in an opposite direction about the inner mandrel towards an extended position respectively, the engagement of the downhole end of the sleeve creating debris from the wellbore obstructions, and wherein the fluids from the sleeve bore convey debris along the annulus to surface.

2. The tool of claim 1 wherein the fluids discharged from the sleeve bore are directed at the obstructions to aid in fluidly eroding the obstructions.

3. The tool of claim 1, wherein the helical drive arrangement comprises:

one or more helical grooves in one or the other of the mandrel or sleeve; and one or more corresponding guide pins extending from the other of the sleeve or the mandrel respectively, each of the one or more guide pins engaging one of the one or more helical grooves so as to cause the sleeve to rotate as the sleeve reciprocates axially along the mandrel between the extended and retracted positions, wherein the one or more helical grooves are formed on either of an outside surface of the mandrel or an inside surface of the sleeve and the one or more corresponding guide pins extend radially from the opposing inner surface of the sleeve or the outer surface of the mandrel.

4. The tool of claim 3, wherein the one or more helical grooves are formed on the outer surface of the mandrel and the one or more corresponding guide pins extend radially inwardly from the inner surface of the sleeve.

5. The tool of claim 3, wherein the one or more helical grooves have a uniform pitch along a path of the helical grooves.

6. The tool of claim 5, wherein the one or more helical grooves have a pitch of about 45 degrees along a path of the helical grooves.

7. The tool of claim 3, wherein the one or more helical grooves have a pitch that varies along a path of the helical grooves.

8. The tool of claim 7 wherein the pitch varies from about 60 degrees adjacent an uphole end of the mandrel to about 30 degrees and again to about 60 degrees at a downhole end of the mandrel.

9. The tool of claim 1 further comprising at least one stop formed between the sleeve and the mandrel for limiting the axial movement of the sleeve along the mandrel and for retaining the sleeve thereon.

10. The tool of claim 9 wherein the at least one stop comprises:

an uphole stop formed at an uphole end of the sleeve for engaging an uphole stop formed at an uphole end of the mandrel for limiting the movement of the sleeve in the fully retracted position; and a downhole stop formed at a downhole end of the mandrel for engaging the sleeve's uphole stop for retaining the sleeve thereon in the fully extended position.

11. The tool of claim 1 further comprising a flow restrictor in the sleeve bore for reducing a diameter of the sleeve bore.

12. The tool of claim 1 further comprising a plurality of protrusions formed on a downhole end of the sleeve and circumferentially spaced thereabouts for engaging the wellbore obstructions.

13. The tool of claim 12 wherein the protrusions are formed on a bit connected to the downhole end of the sleeve.

14. The tool of claim 13, wherein the mandrel and at least portions of the bit are made of a drillable material so as to permit drilling out by a secondary drill string for extending the wellbore therebeyond.

15. The tool of claim 14, further comprising a locking mechanism acting between a downhole end of the mandrel and a downhole end of the sleeve for restricting rotational movement of the mandrel when at least portions of the mandrel are drilled out.

16. The tool of claim 1 further comprising a casing shell fit to the mandrel and extending concentrically about the mandrel and extending concentrically and slidably about the sleeve for guiding the secondary drill string therethrough for the extending of the wellbore.

17. The tool of claim 1 wherein the tubing string is casing or coiled tubing.

18. A method for clearing wellbore obstructions within a wellbore for advancing a tubing string therein without rotation of the tubing string, the method comprising:

running a wellbore obstruction-clearing tool on a downhole end of the tubing string for advancing therewith, the wellbore obstruction-clearing tool having an inner tubular mandrel for connection to the tubing string, and an outer tubular sleeve which is axially and rotationally moveable therealong between a retracted position and an extended position; and when the wellbore obstruction-clearing tool encounters a wellbore obstruction;

stroking the tubing string and the inner mandrel downhole and uphole for driving the outer tubular sleeve to rotate in a first direction and then in an opposite direction respectively about the inner tubular mandrel and reciprocate axially between the retracted position and the extended position respectively for engaging the wellbore obstruction and creating debris therefrom; and discharging fluid through contiguous bores in the tubing string, the mandrel and the sleeve for conveying debris to surface.

19. The method of claim 18, wherein the discharging fluid through the contiguous bores further comprises hydraulically extending the tubular sleeve to the extended position as the tubing string is stroked uphole.

20. The method of claim 18 when the tool encounters the wellbore obstruction further comprising:

setting the tool down on the obstruction with a set-down load sufficient to shear a shear pin connected between the sleeve and the mandrel so as to free the sleeve to rotate and reciprocate axially.

21. The method of claim 18 further comprising:

cementing the tool and tubing string in the wellbore;

running in a secondary drill string to drill out at least the mandrel for extending the wellbore.

* * * * *